US006497229B1

(12) United States Patent
Maeda

(10) Patent No.: US 6,497,229 B1
(45) Date of Patent: Dec. 24, 2002

(54) AUTOMATIC AIR SPORT GUN

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 0 days.

(21) Appl. No.: 09/762,484

(22) PCT Filed: Mar. 10, 2000

(86) PCT No.: PCT/JP00/01450

§ 371 (c)(1),
(2), (4) Date: Apr. 5, 2001

(87) PCT Pub. No.: WO00/75595

PCT Pub. Date: Dec. 14, 2000

(30) Foreign Application Priority Data

Jun. 7, 1999 (JP) ..... 11-160123

(51) Int. Cl.[7] ..... F41B 11/32
(52) U.S. Cl. ..... 124/76; 124/73; 124/74
(58) Field of Search ..... 124/73, 74, 75, 124/76

(56) References Cited

U.S. PATENT DOCUMENTS 5,476,087 A * 12/1995 Kunimoto ..... 124/73
5,477,843 A * 12/1995 Kunimoto ..... 124/73
5,509,399 A * 4/1996 Poor ..... 124/74
5,664,552 A * 9/1997 Kunimoto ..... 124/73
6,073,620 A * 6/2000 Kunimoto ..... 124/74
6,112,734 A * 9/2000 Kunimoto ..... 124/56
6,158,424 A * 12/2000 Kunimoto ..... 124/73

FOREIGN PATENT DOCUMENTS

| | | |
|---|---|---|
| JP | 2610610 | 2/1997 |
| JP | 2905478 | 3/1999 |
| JP | 11287596 A * | 10/1999 |
| JP | 3059129 | 4/2000 |
| JP | 2000234896 A * | 8/2000 |

* cited by examiner

*Primary Examiner*—Charles T. Jordan
*Assistant Examiner*—John W. Zen
(74) *Attorney, Agent, or Firm*—Foley & Lardner

(57) ABSTRACT

It is possible, in an automatic air gun, to reduce a piston block's size and effectively use a compressed gas' pressure. A change valve and a open-close valve are positioned below a cylinder block. A change valve closing portion is exposed in a change valve gas chamber. The change valve is located so only a rod portion is positioned in the change valve gas chamber. When the compressed gas is supplied to a bullet discharge ventilating opening side, through the change valve gas chamber, the closing portion opens a bullet discharge air-supply opening thereby allowing the compressed gas to flow to the bullet discharge air-supply opening. When the compressed gas is supplied to a blow-back ventilating opening, the closing portion makes a blow-back air-supply opening change to the opening state; the change valve rod prevents supply of the compressed gas to the change valve gas chamber.

3 Claims, 19 Drawing Sheets

AUTOMATIC AIR SPORT GUN

BACKGROUND

1. Field of the Invention

This invention relates to an air gun supplied with a compressed fluid such as compressed air, chlorofluorocarbons, or carbon dioxide, for discharging a bullet such as a BB bullet. More particularly, the invention relates to an air gun of automatic bullet supply type that is capable of discharging a bullet, such as a BB bullet, with a gush by a pressure of a compressed fluid and is capable of being automatically loaded with bullets after discharge.

2. Description of the Related Art

Examples of air sport guns are shown in FIGS. 17 to 19 which depict conventional automatic air sport guns which utilizes a compressed gas such as air, chlorofluorocarbons, or carbon dioxide.

A first conventional automatic air gun is described in one of the applicant's previous applications, JP Application Serial No. 9-243358(243358/1997) (hereinafter "Prior Art I"). In the automatic air gun of Prior Art I, a problem exists which involves gas pressure reduction of the compressed gas. The gas pressure reduction occurs on carrying out a bullet discharge and a blow-back at a same time. The gas pressure reduction may occur on the basis of a large cylinder volume or a passage volume for a large bullet discharge.

The automatic air gun described in claim 1 of Prior Art I is characterized by comprising:

a load packing positioned at a gun-rear end side for holding loaded bullets;

a magazine positioned at a position lower than that of the load packing in the gun-rear end side, the magazine having an upper opening and being for holding the bullets to always and upwardly push the held bullets;

a cylinder block having a hollow loading pipe mounted at the side of the load packing and a cylinder portion mounted at the gun-rear end side, the loading pipe having a bullet discharge ventilating opening whose one end communicates with a circumference surface of the cylinder portion side and whose another end communicates with the load packing side, a change valve pushing portion being mounted at a side of the load packing in a circumference surface opening of the cylinder portion side so as to project, the cylinder portion having an opening positioned at the gun-rear end side and a blow-back ventilating opening positioned at a circumference surface of a loading pipe side, the cylinder block being able to slide so as to open and close the opening of the magazine upper portion;

a piston block inserted into the cylinder portion so as to be able to slide in the cylinder block;

a compressed gas chamber positioned at a lower and rear position of the barrel for holding the compressed gas, the compressed gas chamber having an exhaust opening for use in exhausting the compressed gas that is positioned at an upper portion of the compressed gas chamber;

a change valve gas chamber having a bullet discharge air-supplying opening opposite to an opening of the loading pipe circumference surface, the change valve gas chamber having a blow-back air-supplying opening opposite to the blow-back ventilating opening of the cylinder portion, the change valve gas chamber being connected to the lower portion of the cylinder block and the exhaust opening of the compressed gas chamber to be supplied with the compressed gas from the compressed gas chamber;

an open-close valve having a stopper projection mounted at a side end of the change valve gas chamber and being positioned in the exhaust opening to be pushed so as to always make the exhaust opening be a closing state, the open-close valve becoming an opening state when the open-close valve moves against the pushing force, to exhaust the compressed gas to the change valve gas chamber; and a change valve being positioned in the change valve gas chamber and having a projection portion projected to the bullet discharge ventilating opening side at one end of the change valve and a stopper portion capable of stopping the stopper projection of the open-close valve, at another end of the change valve, the change valve carrying out open-close operation of the bullet discharge air-supplying opening so as to supply the compressed gas to the bullet discharge ventilating opening, the change valve making the bullet discharge air-supplying opening be closing state when the stopper portion becomes a stopping state.

In the automatic air sport gun claimed in claim 1 of Prior Art I, the stopper projection is stopped by the stopper portion when the open-close valve changes into, and is maintained in, the opening state and the change valve changes to the closing state. The change valve releases the closing state of the bullet discharge air-supplying opening and the stopper portion releases the stopper projection when the cylinder block slides when the change valve changes to the closing state, so that the projection portion of the change valve is pushed by the change valve pushing portion. As a result, the open-close valve changes to the closing state so that the supply of the compressed gas is stopped.

The automatic air sport gun claimed in claim 2 of Prior Art I is characterized by comprising:

a barrel positioned along a slide in the slide;

a load packing positioned at a gun-rear end side for holding loaded bullets;

a magazine positioned at a position lower than that of the load packing in the gun-rear end side, the magazine having an upper opening and being for holding the bullets to always and upwardly push the held bullets;

a slide mounted from a muzzle to the gun-rear end in a gun upper portion for sliding parallel to the barrel to always be pushed to the muzzle side;

a cylinder block having a hollow loading pipe mounted on the load packing side and a cylinder portion mounted on gun-rear end side, the loading pipe having a bullet discharge ventilating opening whose one end communicates with a circumference surface of the cylinder portion side and whose another end communicates with the load packing side, a change valve pushing portion being mounted at a side of the load packing in a circumference surface opening of the cylinder portion side so as to project, the cylinder portion having an opening positioned at the gun-rear end side and a blow-back ventilating opening positioned at a circumference surface of a loading pipe side, the cylinder block being able to slide so as to open and close the opening of the upper portion of the magazine parallel to the slide;

a piston block mounted on the gun-rear end side of the slide to be capable of being inserted in the cylinder portion, the piston block being able to slide in the cylinder portion together with the movement of the slide;

a hammer rotatably mounted on the gun-rear end side to always rotate towards a muzzle by a applied force;

a sear stopping the hammer rotated towards gun-rear against the applied force to fix the hammer;

a trigger pushed towards the muzzle;

a trigger bar coupled to its one end for synchronizing with the rear movement of the trigger to release the stop of the hammer and the sear in order to rotate the hammer;

a compressed gas chamber positioned at a lower and rear position of the barrel for holding the compressed gas, the compressed gas chamber having an exhaust opening for use in exhausting the compressed gas that is positioned at an upper portion of the compressed gas chamber;

a change valve gas chamber having a bullet discharge air-supplying opening opposite to an opening of the loading pipe circumference surface, the change valve gas chamber having a blow-back air-supplying opening opposite to the blow-back ventilating opening of the cylinder portion, the change valve gas chamber being connected to the lower portion of the cylinder block and the exhaust opening of the compressed gas chamber to be supplied with the compressed gas from the compressed gas chamber;

an open-close valve having a stopper projection which is mounted at a side end of the change valve gas chamber and which is capable of projecting into the change valve gas chamber, the open-close valve having a valve rod which is positioned in opposite to the change valve gas chamber and which is pushed by the hammer, the open-close valve being positioned in the exhaust opening of the compressed gas chamber to be pushed so as to always make the exhaust opening be a closing state, the open-close valve moving against the pushing force to become an opening state when the valve rod is pushed by the hammer rotated to the muzzle side, to exhaust the compressed gas to the change valve gas chamber; and a change valve being positioned in the change valve gas chamber and having a closing portion which is for use in closing the bullet discharge air-supplying opening, the change valve being always pushed so as to close the bullet discharge air-supplying opening, the change valve having a projection portion projected to the bullet discharge ventilating opening side at the bullet discharge ventilating opening side end of the closing portion in case where the closing portion closes the bullet discharge air-supplying opening, the change valve having a stopper portion capable of stopping the stopper projection of the open-close valve, at another end of the change valve when the open-close valve becomes the opening state, the change valve carrying out open-close operation of the bullet discharge air-supplying opening so as to supply the compressed gas to the bullet discharge ventilating opening, the change valve making the bullet discharge air-supplying opening be closing state when the stopper portion becomes a stopping state.

In the automatic air sport gun claimed in claim 2 of Prior Art I, the stopper projection is mounted on the middle portion of the slide. The stopper projection engages with the cylinder block when the slide slides in maximum towards the rear of the gun, so that it is possible for the loading pipe head of the cylinder block to locate in a rearward position from the opening formed on the upper portion of the magazine. When the slide slides towards the rear of the gun, the piston block and the cylinder block also are slid. The gun-rear side end of the piston block pushes the hammer so that the hammer rotates against the applied force. The hammer engages with the sear to move the trigger. As a result, the sear is released from the hammer so that the open-close valve changes to the opening state.

When the open-close valve changes to the opening state, the stopper projection of the open-close valve engages with the stopper portion so that the open-close valve is maintained in the opening state and the change valve changes to the closing state. In the case where the cylinder block slides when the change valve changes to the closing state (so that the projection portion of the change valve is pushed by the change valve-pushing portion), the change valve releases the closing state of the bullet discharge air-supply opening. Furthermore, the change valve releases the engagement between the stopper projection and the stopper portion. As a result, the open-close valve changes to the closing state to stop supplying the compressed gas.

Prior Art I will be described with reference to FIGS. 17 and 18.

A compressed gas chamber 121 is full of the compressed gas. A slide 109 is pulled from a muzzle B side toward a gun-rear end A side. As a result, the slide 109 starts to move towards the rear of the gun against a force applied by a slide spring 110. In this event, a piston block 112 fixed on the gun-rear end A side of the slide 109 is also moved together with the slide 109. When the slide 109 moves and a stopper projection 111 mounted in the middle portion of the slide 109 engages with a cylinder block 114, the cylinder block 114 is also moved towards the rear of the gun. Soon, the gun-rear side end of the piston block 112 contacts a hammer 141 and rotates the hammer 141 towards the gun-rear end A side against the applied force of the hammer spring 143. As a result, the hammer 141 engages a sear 145. On the other hand, when a head of a loading pipe 115 of the cylinder block 114 moves to the gun-rear end A side thereby passing an opening formed on the upper portion of a magazine 102, a bullet W held in the magazine 102 is driven to the top of the opening of the magazine upper portion by a magazine spring 103.

Next, when slide 109 finishes moving towards the gun-rear end A side, the slide 109 will return back to the muzzle B side by force applied by the slide spring 110. At that time, as the piston block 112 moves together with the slide 109, the cylinder block 114 holding the piston block 112 therein is moved towards the side of the muzzle B. As a result, the head of the loading pipe 115 makes the bullet W of the uppermost position in the magazine 102 move towards the muzzle B. The bullet W is loaded in a load packing 108.

After the first bullet W is loaded, a user pulls a trigger 151. As a result, a trigger bar 152 moves in synchronization with the trigger 151 so that the sear 145 releases the hammer 141. The hammer 141 rotates towards the side of the muzzle B to push a valve rod 132 of a open-close valve 129. When the valve rod 132 is pushed, the open-close valve 129 changes to an opening state. The compressed gas in the compressed gas chamber 121 flows into a change valve gas chamber 126 through the open-close valve 129. At that time, as a closing portion of the change valve 134 does not close a bullet discharge air-supply opening 127, the compressed gas quickly travels from the bullet discharge air-supply opening 127 to the load packing 108 through a bullet discharge ventilating opening 117. The loaded bullet W is pushed by the gas pressure to be moved in a barrel 105, in order to discharge the bullet W from the muzzle B to the outside. At the same time, the compressed gas is supplied to a blow-back ventilating opening 119 through a blow-back air-supply opening 128.

At this moment, when the open-close valve changes to the opening state, the closing portion 136 of the change valve 134 closes the bullet discharge supply-opening 127 so that the stopper portion 131 of the open-close valve 129 engages with the stopper portion 137 of the change valve 134. As a result, the compressed gas is not supplied to the bullet discharge ventilating opening 117. Namely, the supply of the compressed gas is stopped at the bullet discharge ventilating opening 117. Accordingly, the compressed gas is only supplied to the blow-back ventilating opening 119. The compressed gas supplied to the blow-back ventilating opening 119 expands a hollow portion 120 of a cylinder portion 116 by its gas pressure so that a piston 112 moves towards the gun-rear side A. The slide 109, on which the piston block 112 is fixed, also moves towards the gun-rear side A. When the slide 109 moves towards the gun-rear side A, the stopper projection 111 of the slide middle portion engages with the cylinder block 114. As a result, the cylinder block 114 also moves towards the gun-rear side A.

When the cylinder block 114 also moves towards the gun-rear A, the change valve pushing portion 118 of the loading pipe 115 pushes the projection portion 135 of the change valve 134. Against the applied force, the change valve 134 moves towards a direction at which the the closing mechanism of the bullet discharge air-supply opening 127 is released. As a result, the close is released. Then, the stopper portion 137 of the change valve 134 is released from the stopper projection 131 of the open-close valve 129 so that the open-close valve 129 changes to the closing state. The supply of the compressed gas is stopped.

On the other hand, the piston block 112 contacts the hammer 141 at the side end of the gun-rear A. Furthermore, the piston block 112 rotates the hammer 141 against the force applied by the hammer spring 143 to engage the hammer 141 with the sear 145. In addition, when the head of the loading pipe 115 of the cylinder block 114 moves towards gun-rear A and passes the opening formed on the upper portion of the magazine 102, a second bullet W held in the magazine 102 is directed through the opening of the magazine upper portion by the magazine spring 103.

In this condition, as the compressed gas is not supplied to the cylinder block 114, the slide 109 stops moving towards the gun-rear A. The slide 109 returns back to the side of the muzzle B by the applied force applied by the slide spring 110. At that time, as the piston block 112 moves together with the slide 109, the piston block 114 moves towards the side of the muzzle. The head of the loading pipe 115 makes the second bullet W of the magazine 102 move towards the muzzle B so that the bullet W is loaded in the load packing 108.

After the second bullet W is loaded, the user pulls the trigger 151. As a result, the trigger bar 152 moves in synchronization with the trigger 151 so that the sear 145 releases the hammer 141. The hammer 141 rotates towards the muzzle B to push the valve rod 132 of a open-close valve 129. When the valve rod 132 is pushed, the open-close valve 129 changes to the opening state. The compressed gas in the compressed gas chamber 121 flows into the change valve gas chamber 126 through the open-close valve 129. At that time, as the closing portion 136 of the change valve 134 does not close the bullet discharge air-supply opening 127, the compressed gas instantly passes through the bullet discharge air-supply opening 127 to the load packing 108 through a bullet discharge ventilating opening 117. The loaded bullet W is pushed by the gas pressure into a barrel 105, in order to discharge the bullet W from the muzzle B to the outside.

When each of the slide 109, the cylinder block 114, and the piston block 112 moves towards the muzzle B, the head of the loading pipe 115 pushes the bullet W supplied into the chamber 104. When the movement of the slide 109 towards the muzzle B finishes, the second bullet W is loaded in the load packing 108.

When the trigger 151 is pulled, the second bullet W is discharged. By repeating above-mentioned operation, it is possible to continuously discharge the bullets W.

However, as the change valve 134 is in the path of the compressed gas in Prior Art I, a problem arises in that the path of the compressed gas is narrow. To overcome this narrow path problem, the applicant invented an "air gun" filed as J.P. Application Serial No. 10-166079(166079/1998) (hereinafter "Prior Art II").

The air gun claimed in claim 1 of Prior Art II is characterized by comprising:

a barrel positioned in a gun;

a load packing positioned at a gun-rear end side of the barrel for holding loaded bullets;

a cylinder block positioned so □ as to move towards the gun-rear and having a loading pipe mounted on the load packing side and a cylinder portion mounted on the gun-rear end side, the loading pipe having a bullet discharge ventilating opening whose one end communicates with a circumference surface of the cylinder portion side and whose another end communicates with the load packing side, the cylinder portion having an opening positioned at the gun-rear end side and a blow-back ventilating opening positioned at a loading pipe side circumference surface;

a compressed gas chamber positioned at a lower position of cylinder block for holding the compressed gas, the compressed gas chamber having an exhaust opening for use in exhausting the compressed gas that is positioned at an upper portion of the compressed gas chamber;

an air-supply path positioned between the cylinder block and the compressed gas chamber and having a bullet side path and a cylinder side path, the bullet side path being connected to the exhaust opening of the compressed gas chamber at one end, the bullet side path having an opening positioned opposite to a bullet discharge ventilating opening formed on cylinder side circumference surface of the loading pipe at another end, the cylinder side path having an opening positioned opposite to a blow-back ventilating opening formed on the cylinder portion circumference surface;

an open-close valve positioned between the exhaust opening of the compressed gas chamber and the air-supply path, the open-close valve always making the exhaust opening be a closing state by an applied force, the open-close valve exhausting the compressed gas to the air-supply path when the open-close valve moves against the applied force to become an opening state; and a change valve positioned at a branch point of the air-supply path for closing the bullet side path by rotating around one end as a rotating end when the gas pressure of the compressed gas flowing to the bullet side path is lower than the gas pressure of the compressed gas flowing to the cylinder side path.

The air gun claimed in claim 2 of Prior Art II is characterized by comprising:

a barrel positioned in a gun;

a load packing positioned at a gun-rear end side of the barrel for holding loaded bullets;

a magazine positioned at a position lower than that of the load packing in the gun-rear end side, the magazine having an upper opening and being for holding the bullets to always and upwardly push the held bullets;

a cylinder block positioned at the gun-rear side of the load packing so as to move towards the gun-rear, the cylinder block having a loading pipe mounted on the load packing side and a cylinder portion mounted on the gun-rear end side, the loading pipe having a bullet discharge ventilating opening whose one end communicates with a circumference surface of the cylinder portion side and whose another end communicates with the load packing side, the cylinder portion having an opening positioned at the gun-rear end side and a blow-back ventilating opening positioned at a loading pipe side circumference surface, the cylinder block sliding to open and close the opening of the magazine upper portion;

a piston block positioned in the cylinder portion so as to be able to slide in the cylinder portion;

a compressed gas chamber positioned at a lower position of cylinder block for holding the compressed gas, the compressed gas chamber having an exhaust opening for use in exhausting the compressed gas that is positioned at an upper portion of the compressed gas chamber;

an air-supply path positioned between the cylinder block and the compressed gas chamber and having a bullet side path and a cylinder side path, the bullet side path being connected to the exhaust opening of the compressed gas chamber at one end, the bullet side path having an opening positioned opposite to a bullet discharge ventilating opening formed on cylinder side circumference surface of the loading pipe at another end, the cylinder side path having an opening positioned opposite to a blow-back ventilating opening formed on the cylinder portion circumference surface, the air-supply path to which the compressed gas is supplied from the compressed gas chamber;

an open-close valve positioned between the exhaust opening of the compressed gas chamber and the air-supply path, the open-close valve always making the exhaust opening be a closing state by an applied force, the open-close valve exhausting the compressed gas to the air-supply path when the open-close valve moves against the applied force to become an opening state; and a change valve positioned at a branch point of the air-supply path for closing the bullet side path by rotating around one end as a rotating end when the gas pressure of the compressed gas flowing to the bullet side path is lower than the gas pressure of the compressed gas flowing to the cylinder side path.

In the air gun as claimed in claim 2 of Prior Art II, the compressed gas is supplied to the bullet discharge ventilating opening and the blow-back ventilating opening through the air-supply path when the open-close valve becomes the opening state, in order to discharge the bullet. After discharging the bullet, the bullet discharge ventilating opening has a negative pressure lower than a pressure of the blow-back ventilating opening. As a result, the change valve closes the bullet side path of the air-supply path.

The air gun claimed in claim 3 of Prior Art II is characterized by comprising:

a barrel positioned in a gun;

a load packing positioned at a gun-rear end side of the barrel for holding loaded bullets;

a magazine positioned at a position lower than that of the load packing in the gun-rear end side, the magazine having an upper opening and being for holding the bullets to always and upwardly push the held bullets;

a slide positioned between a muzzle and the gun-rear side in an upper portion of the gun to slide parallel to the barrel, the slide being always pushed to the muzzle side by an applied force;

a cylinder block positioned at the gun-rear side of the load packing so as to move towards the gun-rear, the cylinder block having a loading pipe mounted on the load packing side and a cylinder portion mounted on the gun-rear end side, the loading pipe having a bullet discharge ventilating opening whose one end communicates with a circumference surface of the cylinder portion side and whose another end communicates with the load packing side, the cylinder portion having an opening positioned at the gun-rear end side and a blow-back ventilating opening positioned at a loading pipe side circumference surface, the cylinder block being slid parallel to the slide so as to open and close the opening of the magazine upper portion;

a piston block positioned at the gun-rear side of the slide so as to be inserted in the cylinder portion, the piston block being slid parallel to the slide so as to open and close the opening of the magazine upper portion;

a hammer rotatably mounted on the gun-rear end side to always rotate towards a muzzle by a applied force, the hammer having a valve rod which eccentrically rotates to a rotating axis, the hammer pushing an open-close valve;

a sear for stopping the hammer rotated towards the gun-rear against the applied force to fix the hammer;

a trigger pushed towards the muzzle;

a trigger bar coupled to its one end for synchronizing with the rear movement of the trigger to release the stop of the hammer and the sear in order to rotate the hammer;

a compressed gas chamber positioned at a lower position of cylinder block for holding the compressed gas, the compressed gas chamber having an exhaust opening for use in exhausting the compressed gas that is positioned at an upper portion of the compressed gas chamber;

an air-supply path positioned between the cylinder block and the compressed gas chamber and having a bullet side path and a cylinder side path, the bullet side path being connected to the exhaust opening of the compressed gas chamber at one end, the bullet side path having an opening positioned opposite to a bullet discharge ventilating opening formed on cylinder side circumference surface of the loading pipe at another end, the cylinder side path having an opening positioned opposite to a blow-back ventilating opening formed on the cylinder portion circumference surface, the air-supply path to which the compressed gas is supplied from the compressed gas chamber;

an open-close valve positioned between the exhaust opening of the compressed gas chamber and the air-supply path, the open-close valve having a valve portion at a side end portion of the compressed gas chamber that is for opening and closing the exhaust opening, the open-close valve having a valve head extending from the valve portion at another end, the open-close valve always making the exhaust opening be a closing state by an applied force, the open-close valve being pushed at the valve head by the valve rod of the hammer to exhaust the compressed gas to the air-supply path when the open-close valve moves against the applied force to become an opening state; and a change valve positioned at a branch point of the air-supply path for closing the bullet side path by rotating around one end as a rotating end when the gas pressure of the compressed gas flowing to the bullet side path is lower than the gas pressure of the compressed gas flowing to the cylinder side path.

In the air gun as claimed in claim 3 of Prior Art II, the stopper projection is mounted on the middle portion of the slide. The stopper projection engages with the cylinder block when the slide slides in maximum towards the rear of the gun, so that it is possible for the loading pipe head of the cylinder block to locate in a rearward position from the opening formed on the upper portion of the magazine. When the slide slides towards the rear of the gun, the piston block and the cylinder block also are slid. The gun-rear side end of the piston block pushes the hammer so that the hammer rotates against the applied force. The hammer engages with the sear to move the trigger. As a result, the sear is released from the hammer so that the open-close valve changes to the opening state by the hammer. When the open-close valve changes to the opening state, the compressed gas is supplied to the bullet discharge ventilating opening and the blow-back ventilating opening through the air-supply path. As a result, the bullet is discharged.

After discharging bullet, the pressure of the compressed gas in the bullet discharge ventilating opening is lower than the pressure of the compressed gas in the blow-back ventilating opening. The change valve rotates so that the bullet side path of the air-supply path changes to the closing state. The compressed gas is not supplied to the bullet discharge ventilating opening. Namely, the compressed gas is stopped which is supplied to the bullet discharge ventilating opening. The air gun has a structure shown in FIG. 19.

When the slide 209 is pulled from the side of the muzzle B to the side of gun rear end A, the slide 209 starts to move rearward against the applied force. The piston block 212 fixed on the side of the gun rear end A of the slide 209 moves together with the slide 209. When the slide 209 moves so that the stopper projection 211 mounted on the middle portion of the slide 209 engages with cylinder block 214, the cylinder block 214 also moves rearward. Soon, the side of the gun-rear end A of the piston block 212 contacts the hammer 241 to rotate the hammer 241 against the applied force, to engage the hammer 241 with the sear 245. On the other hand, when the head of the loading pipe 215 of the cylinder block 214 moves towards the gun-rear side A from the opening formed on the upper portion of the magazine 202, the bullet W held in the magazine 202 is directed through the opening formed on the upper portion of the magazine 202.

Next, when the slide 209 finishes moving towards the gun-rear side A, the slide 209 returns back to the side of the muzzle B on the basis of the applied force. At that time, when the piston block 212 moves together with the slide 209, the cylinder block 214 holding the piston block 212 therein moves towards the side of the muzzle B. The head of the loading pipe 215 moves the bullet W out of the uppermost position in the magazine 202 towards the muzzle B. The bullet W is loaded in the load packing 208. The loaded bullet W becomes a first bullet W.

After the first bullet W is loaded, a user pulls the trigger 251. Then, the trigger bar moves in synchronization with the trigger 251 so that the sear 245 releases the hammer 241. The hammer 241 rotates towards the muzzle B to push the open-close valve 229. When the open-close valve 229 is pushed, the open-close valve 229 changes to the opening state. The compressed gas in the compressed gas chamber 221 flows into the air-supply path 226 through the open-close valve 229. Then, the compressed gas instantly flows into the bullet discharge ventilating opening 217 of the cylinder block 214 through the bullet side path 227 of the air-supply path 226 to reach to the load packing 208.

The loaded bullet W is pushed by the gas pressure to be moved in a barrel 205, in order to discharge the bullet W from the muzzle B to the outside. At the same time, the compressed gas is supplied to the blow-back ventilating opening 219 through the cylinder side path 228 of the air-supply path 226. The compressed gas slightly expands a hollow portion of the cylinder portion 216 by its gas pressure. When the first bullet W held in the load packing 208 is discharged from the muzzle B, the resistance the compressed gas in the bullet side path of the air-supply path 226 is instantly reduced. As a result, the pressure of the bullet side path 227 is lower than that of the cylinder side path 228 so that the change valve 234 rotates around the rotating end 235 to close the bullet side path 227. Therefore, the compressed gas is no longer supplied to the bullet discharge ventilating opening 217. Rather, the compressed gas is only supplied to the blow-back ventilating opening 219.

The compressed gas supplied to the blow-back ventilating opening 219 expands the hollow portion of the cylinder portion 216 by its gas pressure so that a piston block 212 moves towards the gun-rear side A. The slide 209, on which the piston block 212 is fixed, also moves towards the gun-rear side A. When the slide 209 moves towards the gun-rear, the stopper projection 211 of the slide middle portion engages with the cylinder block 214. As a result, the cylinder block 214 also moves towards the gun-rear side A. Soon, the gun-rear side end of the piston block 212 contacts the hammer 241 and rotates the hammer 241 against the applied force. When the hammer 241 is rotated towards the gun-rear, the hammer 241 releases the push of the open-close valve 229. As a result, the open-close valve 229 changes to the closing state.

Even if the open-close valve 229 changes to the closing state and the compressed gas is further stopped which is supplied to the cylinder portion 216, the slide 209 continues to move towards the gun-rear side A on the basis of an inertial force. As a result, the piston block 212 further rotates the hammer 241 towards the gun-rear and engages the hammer 241 with the sear 245. In addition, when the head of the loading pipe 215 of the cylinder block 214 has moved to the gun-rear side A from the opening formed on the upper portion of the magazine 202, a second bullet W held in the magazine 202 is directed through the opening formed on the upper portion of the magazine 202.

After the slide 209 finishes moving towards the gun-rear side A, the slide 209 returns back to the side of the muzzle B on the basis of the applied force. At that time, when the piston block 212 moves together with the slide 209, the cylinder block 214 moves towards the side of the muzzle B. The head of the loading pipe 215 moves the second bullet W in the magazine 202 towards the muzzle B to load the bullet W in the load packing 208.

On the other hand, when the compressed gas supplied to the cylinder side path 228 is stopped, the change valve 234 rotates around the rotating end 235 to make the bullet side path 227 change to the opening state.

After the second bullet W is loaded, the user pulls the trigger 251. Then, the trigger bar moves in synchronization with the trigger 251 so that the sear 245 releases the hammer 241. The hammer 241 rotates towards the muzzle B to push the open-close valve 229. When the open-close valve 229 is pushed, the open-close valve 229 changes to the opening state. The compressed gas in the compressed gas chamber 221 flows into the air-supply path 226 through the open-close valve 229.

At that time, when the change valve 234 closes the bullet side path 227, the compressed gas reaches from the bullet side path 227 to the load packing 208 through bullet discharge ventilating opening 217 to push the second loaded bullet W on the basis of the gas pressure, to move the second loaded bullet W in the barrel 205. As a result, the second loaded bullet W is discharged from the muzzle B to the outside. At the same time, the compressed gas is also supplied to the cylinder portion 216 through cylinder side path 228 and the blow-back ventilating opening 219. The operation is repeated which is similar in a manner described in conjunction with the first bullet W.

As previously described, according to Prior Art II, the problem of Prior Art I is resolved, i.e., it is possible to reduce the resistance where the compressed gas flows with a gush (when the change valve has a small size which exists in the path in which the compressed gas flows).

However, when the compressed gas is supplied to the bullet side path 227 and the cylinder side path 228 through the open-close valve 229 to be supplied to both of the bullet discharge ventilating opening 217 and the blow-back ventilating opening 219 (when the hammer 241 is pulled so that the open-close valve 229 changes to the opening state), the gas pressure of the compressed gas is applied to both of the ventilating openings to carry out the bullet discharge and the blow-back. Therefore, Prior Art II has a problem in which the power, i.e. speed, of the bullet discharge is reduced by half Furthermore, the change valve 229 is made from a soft plastic material capable of bending at a middle position between a rotating end and a closing portion, taking simplicities of a manufacturing cost and a manufacturing process into consideration. Further, as the change valve 234 has a structure in which the closing portion bends around the rotating end to close the bullet side path (after prolonged use), the compressed gas may leak to the bullet side path in spite of an attempted closing of the bullet side path 227. Accordingly, Prior Art II has a problem in which the change valve made from the soft plastic material may be degraded in quality.

SUMMARY

Therefore, it is an object of this invention to effectively use the gas pressure of the compressed gas on discharging the bullet and to discharge the bullet without reducing an initial speed of the bullet. Furthermore, it is another object of this invention to miniaturize the slide of the air gun upper portion or the piston block. It is still another object of this invention to subject the change valve to prolonged use without experiencing degradation.

According to a first aspect of this invention, there is provided an automatic air sport gun having a muzzle end and a gun-rear end, the gun comprising:

a compressed gas chamber positioned at a lower position of a barrel for holding a compressed gas, the compressed gas chamber having an exhaust opening for use in exhausting the compressed gas that is positioned at an upper portion of the compressed gas chamber;

a change valve gas chamber having an air-supply opening at a side end of the compressed gas chamber, the air-supply opening being supplied with the compressed gas from the compressed gas chamber, the change valve gas chamber having a bullet air-supply opening at a side end of the barrel, the bullet air-supply opening being for use in supplying the compressed gas for discharging a bullet, the change valve gas chamber having a blow-back air-supply opening adjacent to a side of the gun-rear end of the bullet air-supply opening, the blow-back air-supply being for use in supplying the compressed gas for carrying out a blow-back of a slide;

an open-close valve positioned between the exhaust opening of the compressed gas chamber and the air-supply opening of the change valve gas chamber, the open-close valve being always pushed so as to make the air-supply opening be in a closing state, the open-close valve making the air-supply opening be in an opening state to exhaust the compressed gas in the compressed gas chamber to the change valve gas chamber when the open-close valve is moved against an applied force; and a change valve having a head exposed in the change valve chamber, a part of the head forming a closing portion, the change valve being always pushed to the side of the gun-rear end to close the blow-back air-supply opening by the closing portion, the closing portion making the blow-back air-supply opening be in an opening state and making a bullet discharge air-supply opening be in a closing state when the change valve is slid towards a side of a muzzle against an applied force;

the change valve being slid when a pressure becomes negative in a front surface of the head of the change valve.

According to a second aspect of this invention, there is provided an automatic air sport gun characterized by comprising:

a slide positioned from a muzzle to a side of a gun-rear end on a gun main body, the slide being always pushed towards a side of the muzzle to be able to slide to both directions of the muzzle and said gun-rear end;

a barrel positioned in the slide and along the slide;

a load packing positioned at a side of the gun-rear end for holding loaded bullets;

a magazine positioned at a position lower than that of the load packing in the side of the gun-rear end, the magazine having an upper opening and being for holding the bullets to always push the held bullets upwardly;

a cylinder block positioned at the load packing in the side of the gun-rear end, the cylinder block having a hollow loading pipe mounted at a side of the load packing, the cylinder block having a cylinder portion mounted at the side of the gun-rear end, the loading pipe having a bullet discharge ventilating opening whose one end communicates with a circumference surface of the cylinder portion side and whose another end communicates with the load packing side, the cylinder portion having an opening positioned at the gun-rear end side, the cylinder portion having a blow-back ventilating opening positioned at a loading pipe side circumference surface, the cylinder block being able to slide so as to open and close the upper opening of the magazine;

a piston block fixedly positioned in the cylinder portion for being inserted into the cylinder portion to be able to slide in said cylinder portion;

a compressed gas chamber positioned at a lower and rear position of the barrel for holding a compressed gas, the compressed gas chamber having an exhaust opening for use in exhausting the compressed gas that is positioned at an upper portion of the compressed gas chamber;

a change valve gas chamber having an air-supply opening at a side end of the compressed gas chamber, the air-supply opening being supplied with the compressed gas from the compressed gas chamber, the change valve gas chamber having a bullet air-supply opening and a blow-back air-supply opening at a side end of the barrel, the bullet air-supply opening being positioned opposite to the bullet discharge ventilating opening of the loading pipe, the blow-back air-supply being adjacent to a side of the gun-rear of the bullet air-supply opening and being positioned opposite to the blow-back ventilating opening of the cylinder portion, the change valve gas chamber having a stopper projection at an end portion of a partition which separates the bullet air-supply opening from the blow-back sir-supply opening;

an open-close valve positioned between the exhaust opening of the compressed gas chamber and the air-supply opening of the change valve gas chamber to be always pushed so as to make the air-supply opening be in a closing state, the open-close valve making the air-supply opening be in an opening state to able to exhaust the compressed gas in the compressed gas chamber to the change valve gas chamber when the open-close valve is moved against an applied force; and a change valve having a head exposed in the change valve chamber, a part of the head forming a closing portion, the change valve being always pushed to the side of the gun-rear end to close the blow-back air-supply opening by the closing portion, the closing portion being contact with the stopper projection of the change valve gas chamber to make the blow-back air-supply opening be in an opening state and to make a bullet discharge air-supply opening be in a closing state when the change valve is slid towards a side of a muzzle against an applied force;

the change valve being slid when a pressure becomes negative in a front surface of the head of the change valve.

According to a third aspect of this invention, there is provided an automatic air sport gun characterized by comprising:

a slide positioned from a muzzle to a side of a gun-rear end on a gun main body, the slide being always pushed towards a side of the muzzle to be able to slide to both directions of the muzzle and the gun-rear end;

a barrel positioned in the slide and along the slide;

a load packing positioned at a side of the gun-rear end for holding loaded bullets;

a magazine positioned at a position lower than that of the load packing in the side of the gun-rear end, the magazine having an upper opening and being for holding the bullets to always push the held bullets upwardly;

a cylinder block positioned at the load packing in the side of the gun-rear end, the cylinder block having a hollow loading pipe mounted at a side of the load packing, the cylinder block having a cylinder portion mounted at the side of the gun-rear end, the loading pipe having a bullet discharge ventilating opening whose one end communicates with a circumference surface of the cylinder portion side and whose another end communicates with the load packing side, the cylinder portion having an opening positioned at the gun-rear end side, the cylinder portion having a blow-back ventilating opening positioned at a loading pipe side circumference surface, the cylinder block being able to slide parallel to the slide so as to open and close the upper opening of the magazine;

a piston block fixedly positioned in the cylinder portion for being inserted into the cylinder portion to be able to slide in the cylinder portion as the slide slides;

a hammer attached to a side of the gun-rear end so as to be able to rotate, the hammer being pushed so as to always rotate towards a direction of a muzzle, the hammer having a blow portion at a side of the muzzle;

a sear portion for engaging with the hammer which rotates towards the gun-rear end against an applied force, to fix the hammer;

a trigger being pushed towards the side of the muzzle;

a trigger bar whose one end is connected to the trigger, the trigger bar being synchronized with the trigger which moves rearward, the trigger bar releasing the hammer from the sear portion to rotate the hammer;

a compressed gas chamber positioned at a lower and rear position of the barrel for holding a compressed gas, the compressed gas chamber having an exhaust opening for use in exhausting the compressed gas that is positioned at an upper portion of the compressed gas chamber;

a change valve gas chamber having an air-supply opening at a side end of the compressed gas chamber, the air-supply opening being supplied with the compressed gas from the compressed gas chamber, the change valve gas chamber having a bullet air-supply opening and a blow-back air-supply opening at a side end of the barrel, the bullet air-supply opening being positioned opposite to the bullet discharge ventilating opening of the loading pipe, the blow-back air-supply opening being positioned opposite to the blow-back ventilating opening of the cylinder portion, the change valve gas chamber having a stopper projection at an end portion of a partition which separates the bullet air-supply opening from the blow-back sir-supply opening;

an open-close valve whose one end is able to open and close the air-supply opening of the change valve gas chamber and whose another end is positioned outside the compressed gas chamber and the change valve gas chamber, the open-close valve being positioned between the exhaust opening of the compressed gas chamber and the air-supply opening of the change valve gas chamber so as to be pushed by the blow portion of the hammer, the open-close valve being always pushed so as to usually make the air-supply opening be in a closing state, the open-close valve making the air-supply opening be in an opening state to exhaust the compressed gas in the compressed gas chamber to the change valve gas chamber when the open-close valve is moved against an applied force; and a change valve having a head exposed in the change valve chamber, a part of the head forming a closing portion, the change valve being always pushed to the side of the gun-rear end to close the blow-back air-supply opening by the closing portion, the closing portion being contact with the stopper projection of the change valve gas chamber to make the blow-back air-supply opening be an opening state and to make a bullet discharge air-supply opening be a closing state when the change valve is slid towards a side of a muzzle against an applied force;

stopper portions being formed at slide middle portion and the cylinder block, respectively, to make the cylinder block slide towards a side of the gun-rear end as the slide slides towards the side of the gun-rear end when the stopper portions engages with each other;

a loading pipe head of the cylinder block being positioned at the side of the gun-rear end from the opening formed on the magazine upper portion when the slide slides towards the side of the gun-rear end in maximum;

a contact projection being formed at a lower portion of the piston block to be contact with the hammer in case where the piston block slides towards the side of the gun-rear end together with the slide, the contact portion pushing the hammer to rotate the hammer against an applied force and to engage the hammer with the sear portion; and the change valve slides when a pressure becomes negative in a front surface of the change valve head.

This invention has the following operation.

The slide is slid towards the side of the gun-rear end. When the slide is slid, the side engages with the stopper portion mounted on the cylinder block so that the cylinder block is also slid towards the side of the gun-rear end as the slide slides. Similarly, the contact projection mounted on the piston block is also contact with the hammer when the slide slides towards the side of the gun-rear end. The contact projection rotates the hammer pushed to the side of the muzzle, towards the side of the gun-rear end, as the side is further slid towards the side of the gun-rear end.

When the slide is slid towards the side of the gun-rear end in a maximum, the loading pipe of the cylinder block makes the upper opening of the magazine be the opening state. The hammer engages with the sear portion to maintain a condition in which the hammer is rotated towards the side of the gun-rear end against the applied force. Inasmuch as the upper opening becomes the opening state, the bullet pushed upwardly is released from the restriction of the loading pipe to move upwardly in the magazine.

Next, the slide finishes to slide towards the side of the gun-rear end in order to release the slide. The released slide slides towards the side of the muzzle on the basis of the applied force. As a result, the piston block is also slid towards the side of the muzzle. Although the cylinder block is released from the stopper portion when the slide is slid towards the side of the muzzle, the cylinder block is slid towards the side of the muzzle as the piston block slides towards the side of the muzzle, when the piston block finishes to slide towards the side of the muzzle in the cylinder portion of the cylinder block. The slide slid towards to the side of the muzzle returns back to an initial state. The head of the loading pipe pushes the bullet which is loaded in the magazine and which is moved upwardly, as the cylinder block slides the side of the muzzle. As a result, the bullet is moved towards the side of the muzzle. The moved bullet is held in the load packing.

The trigger is pulled against the applied force. As a result, the trigger bar connected to the trigger is synchronized with the trigger as the trigger moves. As a result, the hammer is released from the sear portion. The hammer, which is restricted to rotate towards the muzzle by the sear, rotates towards the side of the muzzle so that the blow portion of the hammer pushes the open-close valve. As a result, the open-close valve becomes the opening state. When the open-close valve becomes the opening state, the compressed gas in the compressed gas chamber is supplied from the exhaust opening of the compressed gas chamber to the change valve gas chamber.

In the change valve gas chamber, the change valve closes the blow-back air-supply opening and opens the bullet air-supply opening. As a result, the supplied compressed gas is supplied from the bullet air-supply opening to the load packing through the bullet ventilating opening so that the bullet loaded in the load packing is discharged. When the bullet is discharged, the compressed gas is exhausted from the muzzle with a gush. A negative pressure occurs in a front surface of the change valve head. As a result, the change valve slides against the applied force to make the blow-back air-supply opening be the opening state and to make the bullet air-supply opening be the closing state.

Inasmuch as the blow-back air-supply opening becomes the opening state, the compressed gas supplied to the change valve gas chamber is supplied from the blow-back air-supply opening and the blow-back ventilating opening to the cylinder portion. The piston block slides in the cylinder portion on the basis of the expansion of the compressed gas which is supplied to the cylinder block. The slide fixed to the piston block also slides towards the side of the gun-rear end as the piston block slides.

When the slide slides, the stopper portion mounted on the slide engages with the stopper portion mounted on the cylinder block. As a result, the cylinder block is also slid towards the side of the gun-rear end as the slide slides. Similarly, the contact projection mounted on the piston block is contact with the hammer when the slide slides towards the side of the gun-rear end. The contact projection rotates the hammer pushed to the side of the muzzle, towards the side of the gun-rear end, as the slide is further slid towards the side of the gun-rear end.

When the open-close valve is released from the push, the open-close valve is moved on the basis of the applied force to make the exhaust opening of the compressed gas chamber be the closing state. As a result, the compressed gas is not supplied to the change valve gas chamber. Namely, the compressed gas is stopped which is supplied to the change valve gas chamber.

When the slide is slid towards the side of the gun-rear end in a maximum, the loading pipe of the cylinder block makes the upper opening of the magazine be opening state. The hammer engages with the sear portion to maintain a condition in which the hammer is rotated towards the side of the gun-rear end against the applied force. Inasmuch as the upper opening becomes the opening state, the bullet pushed upwardly is released from the restriction of the loading pipe to move upwardly in the magazine.

Next, the slide is slid towards the side of the muzzle on the basis of the applied force. The piston block is also slid towards the side of the muzzle. Although the cylinder block is released from the stopper portion when the slide is slid towards the side of the muzzle, the cylinder block is slid towards the side of the muzzle as the piston block slides towards the side of the muzzle, when the piston block finishes to slide towards the side of the muzzle in the cylinder portion of the cylinder block. The slide slid towards to the side of the muzzle returns back to the initial state. The head of the loading pipe pushes the bullet which is loaded in the magazine and which is moved upwardly, as the cylinder block slides the side of the muzzle. As a result, the bullet is moved towards the side of the muzzle. The moved bullet is held in the load packing. The discharging preparation for the next bullet is completed.

DETAILED DESCRIPTION

Figure 1:
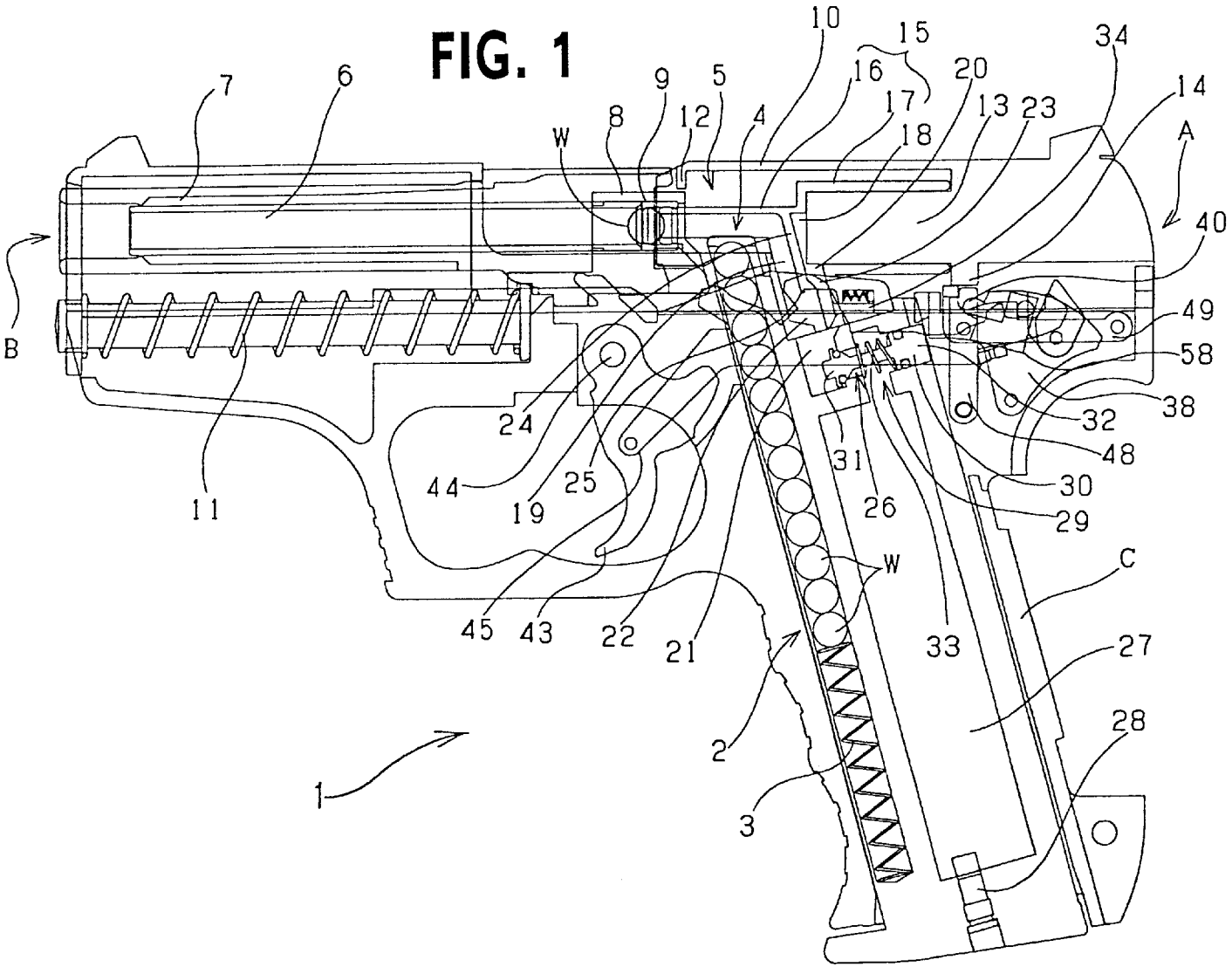
FIG. 1 shows a sectional view for describing an embodiment of this invention.
Figure 2:
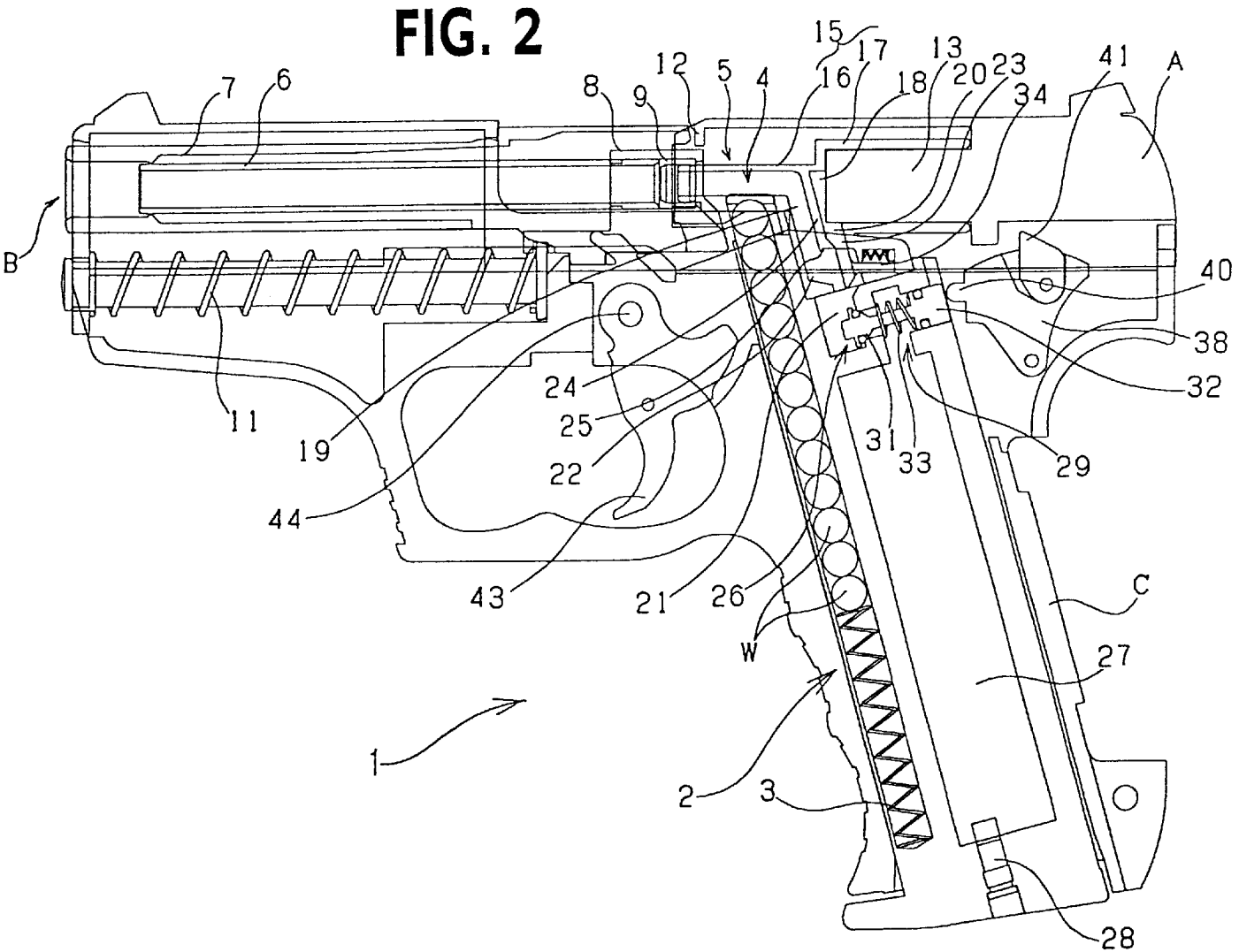
FIGS. 2 and 3 show views for describing an operation in an initial state of this invention.
Figure 3:
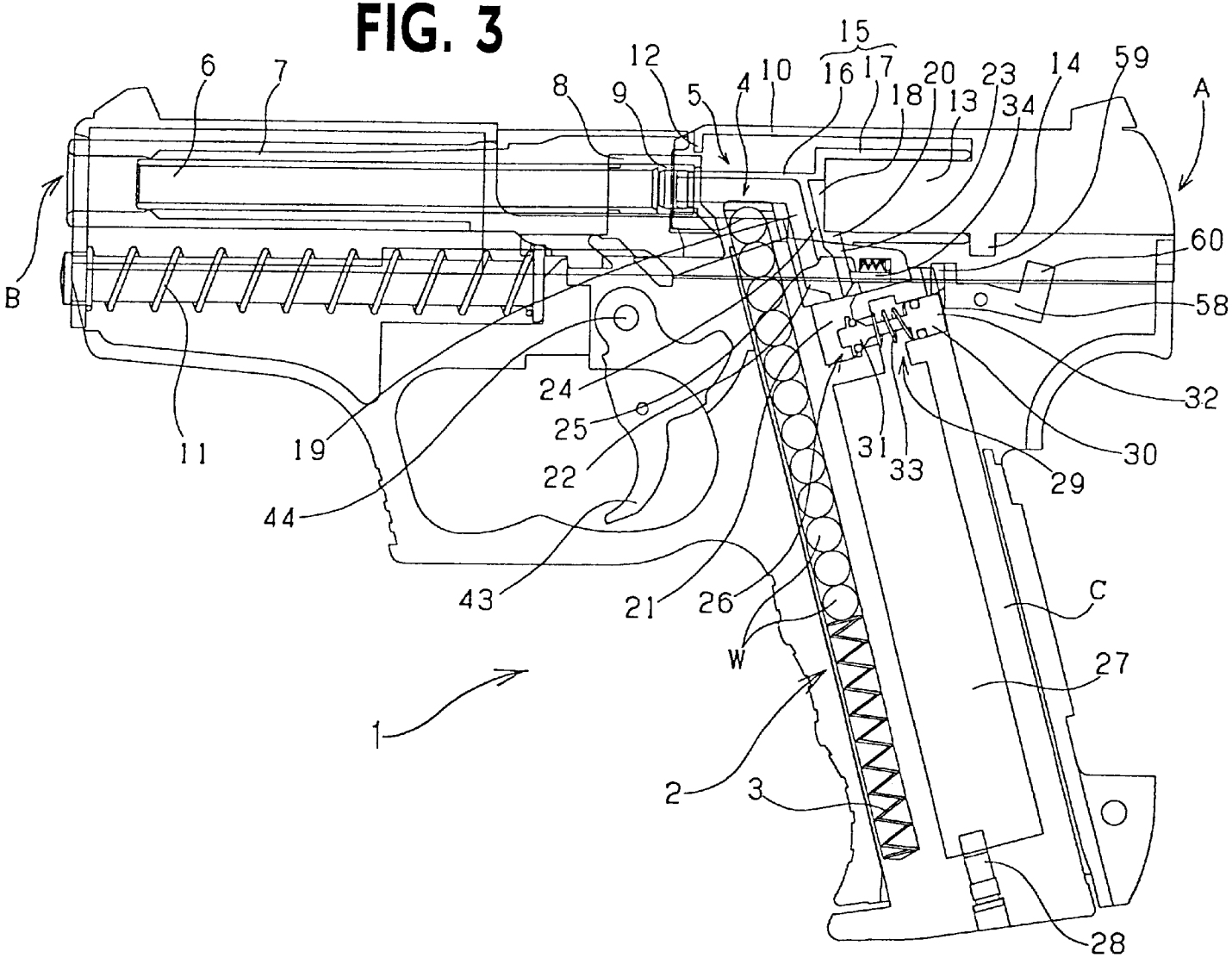
Figure 14:
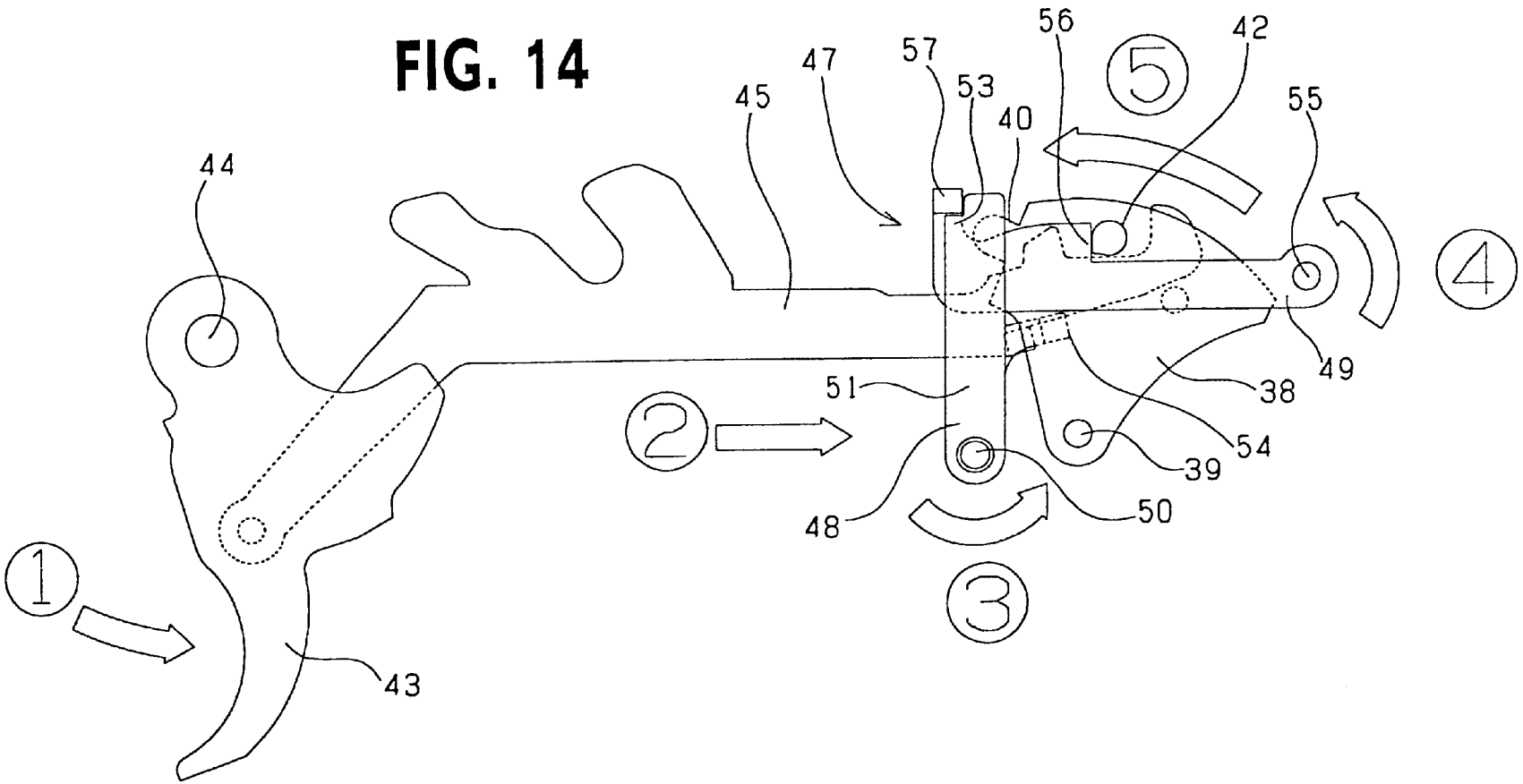
FIGS. 14 to 16 show views for partially describing the embodiment of this invention.
Figure 15B:
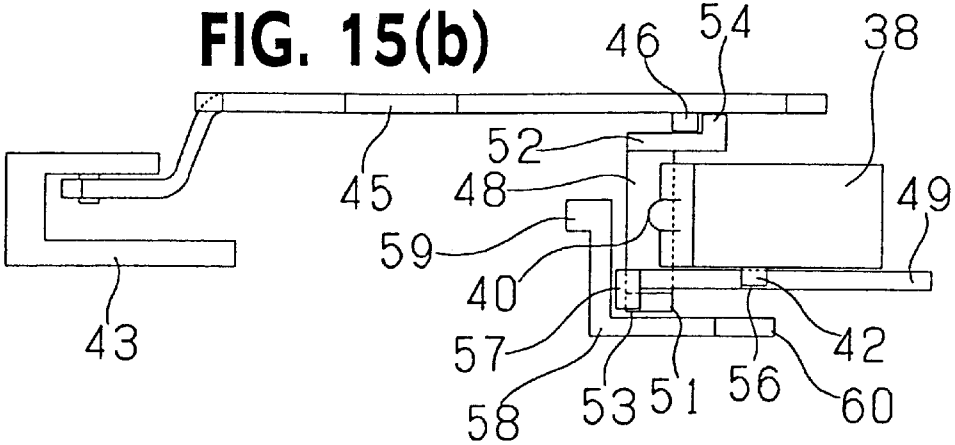
Figure 15A:
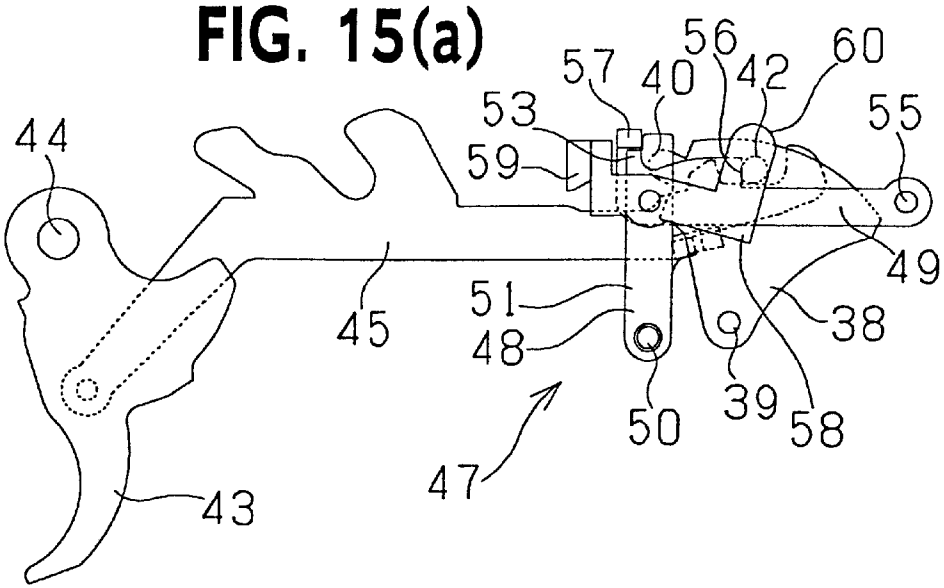
Figure 15C:
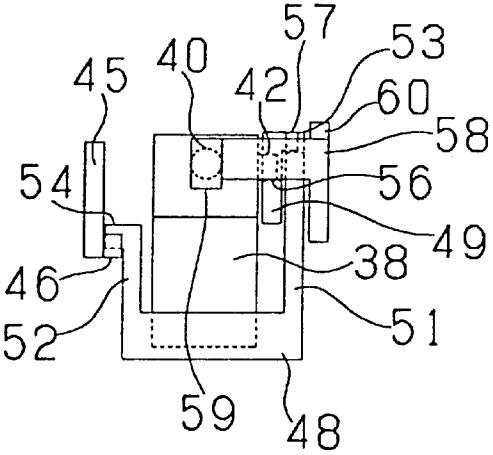
Figure 16A:
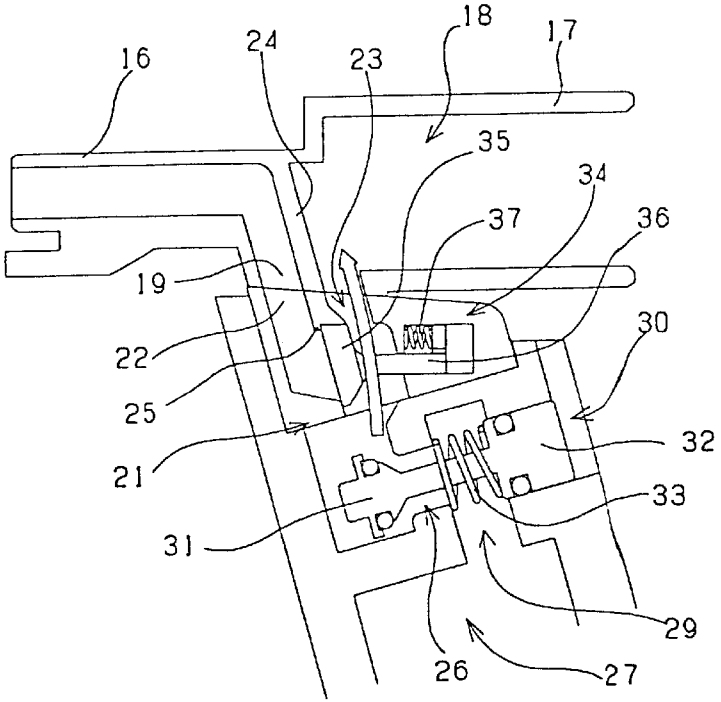
Figure 16B:
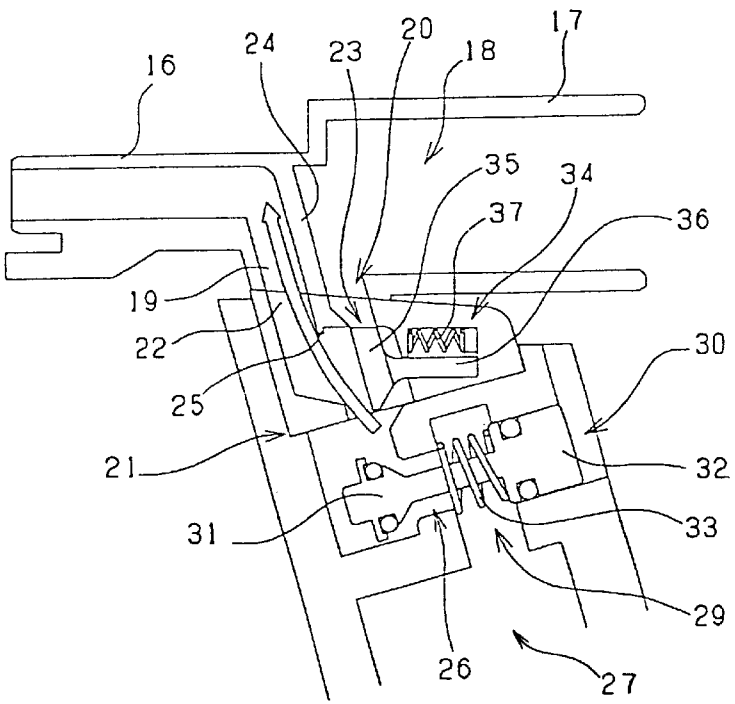
Figure 17:
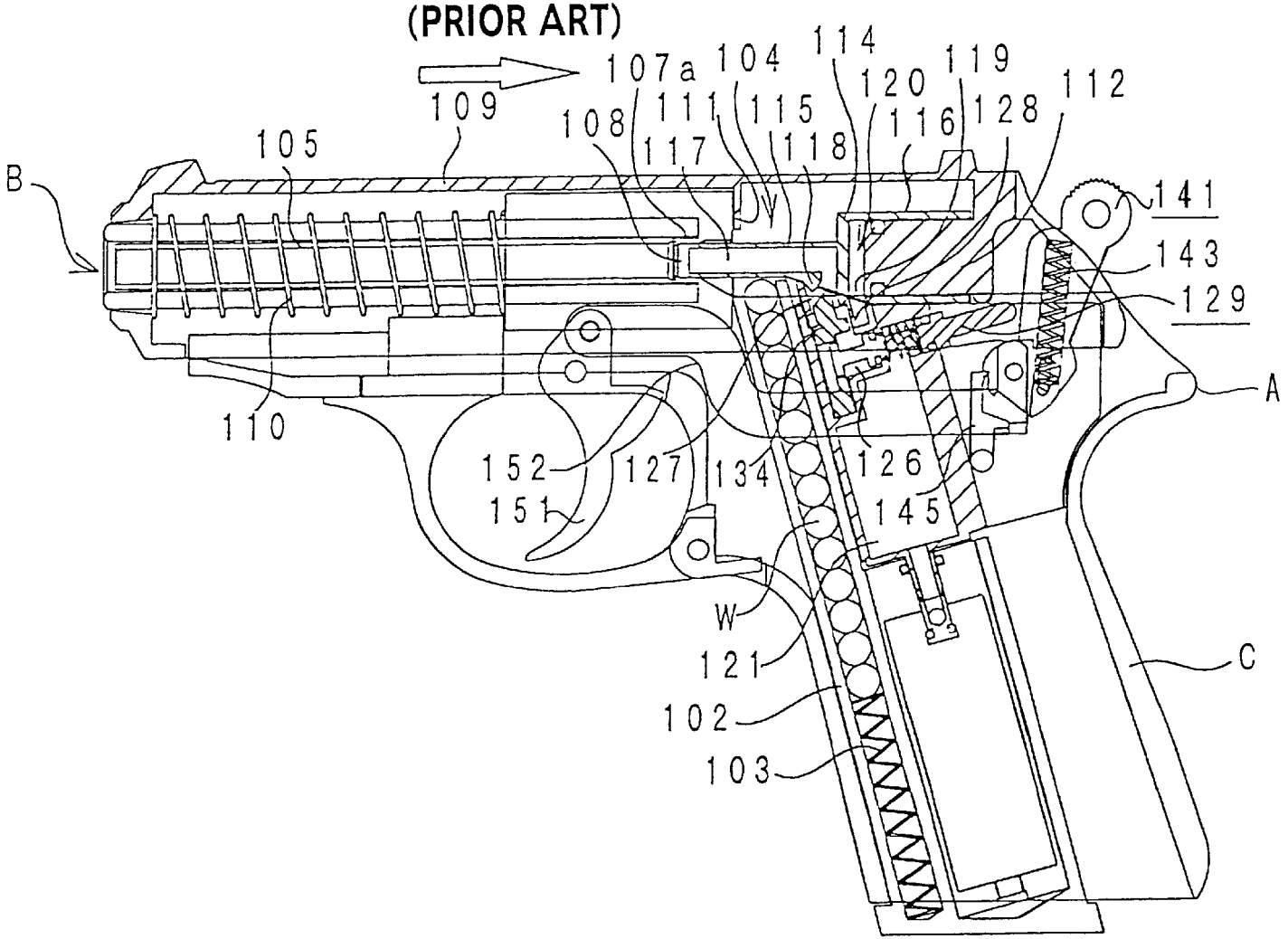
FIG. 17 (PRIOR ART)
FIGS. 17 and 18 show views for describing Prior Art I.
Figure 18B:
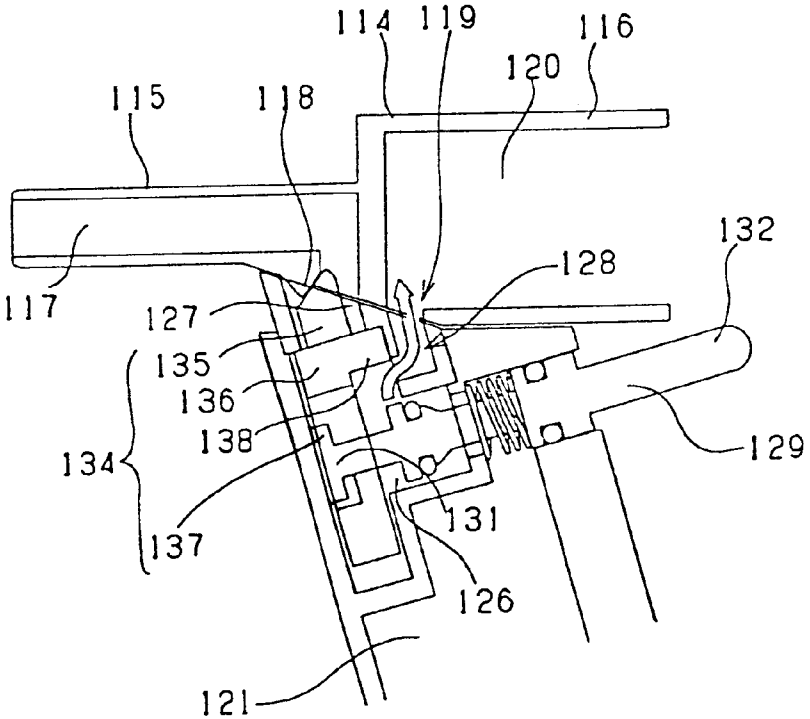
FIG. 18(b) (PRIOR ART)
Figure 18A:
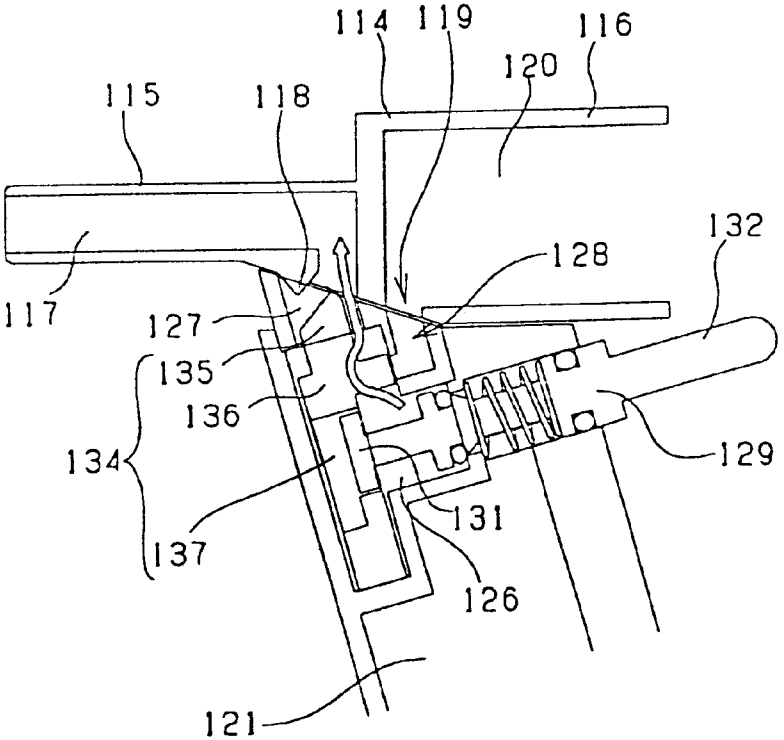
FIG. 18(a) (PRIOR ART)
Figure 19:
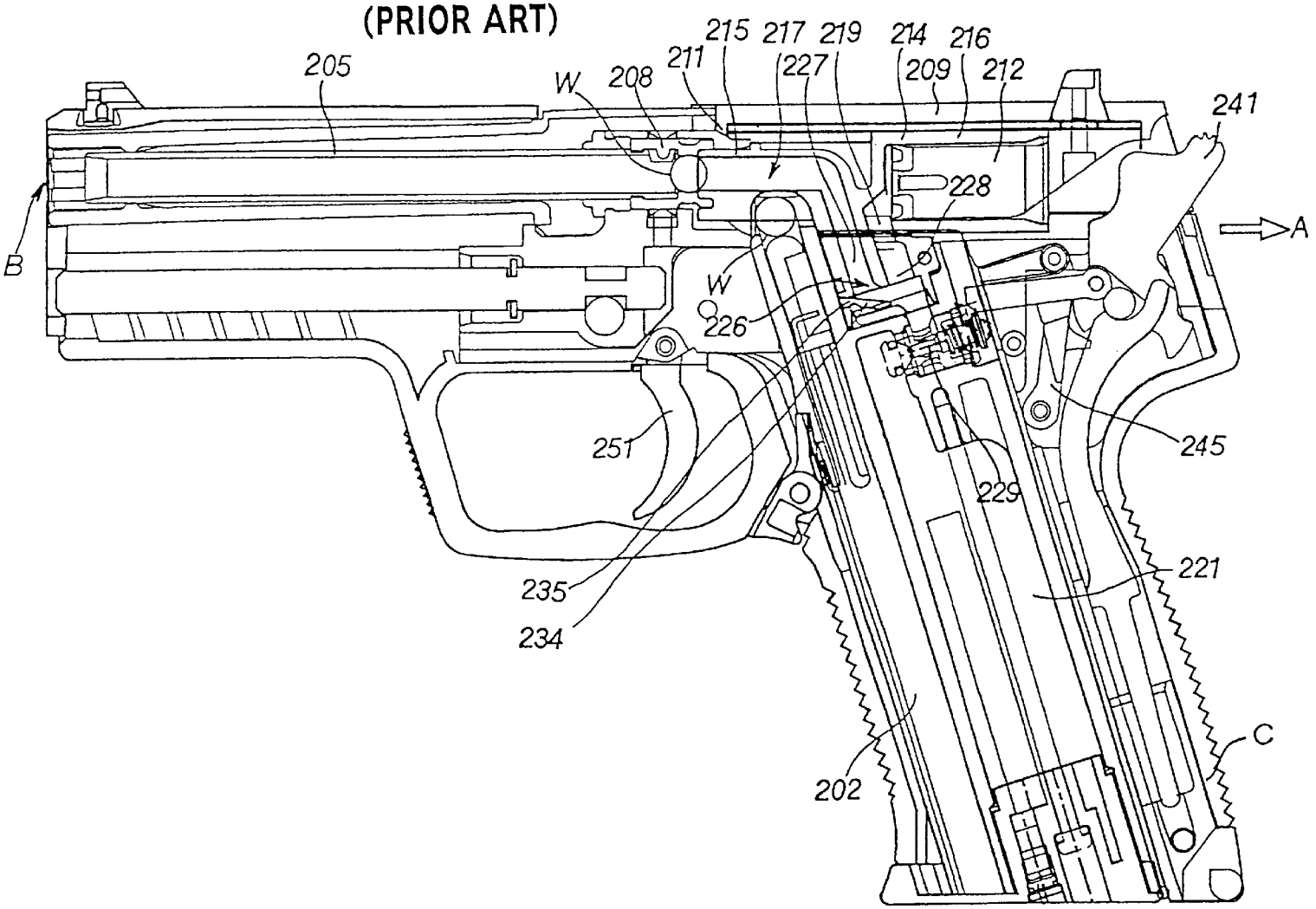
FIG. 19 (PRIOR ART)
FIG. 19 shows a view for describing Prior Art II.

Description will be made as regards an embodiment of this invention with reference to drawings below. FIG. 1 shows a sectional view for describing an embodiment of this invention. FIGS. 2 and 3 show views for describing an operating condition in an initial state of this invention. FIGS. 4 to 13 show views for describing an operating condition of this invention. FIG. 14 shows a view for describing an operation from a trigger to a hammer. FIGS. 15(*a*)–15(*c*) show a view for describing a sear portion: FIG. 15(*a*) shows a side view, FIG. 15(*b*) shows a view from a muzzle side, and FIG. 15(*c*) shows a plan view. FIGS. 16(*a*) and 16(*b*)

show a view for describing a change valve: FIG. 16(*a*) shows a view for describing an operation in which a compressed gas flows to a bullet discharge ventilating opening side and FIG. 16(*b*) shows a view for describing an operation in which a compressed gas flows to a blow-back ventilating opening side.

1 represents an automatic air sport gun according to this invention. The automatic air sport gun 1 will be abbreviated to an air gun 1, below.

2 represents a magazine for holding bullets W. The magazine 2 is held in a grip portion C with removability. The magazine 2 pushes the bullets W upwardly by a magazine spring 3. Furthermore, an upper opening 4 is formed on an upper portion of the magazine 2. The opening 4 has a diameter which is smaller than the diameter of the pushed bullets W and is formed on the upper portion of the air gun 1. In addition, the opening 4 is formed so as to load the bullets W such that they may be driven towards the side of the muzzle B.

5 represents a chamber. The chamber 5 is formed in the air gun 1. The chamber 5 has an opening 4 formed on an upper end of the held magazine 2.

6 represents a barrel. 7 represents an outer barrel. 8 represents a barrel fixing portion. The barrel 6 is mounted from the chamber 5 to the muzzle B. The outer barrel 7 has a pipe shape and the barrel 6 is inserted into the outer barrel 7. The barrel fixing portion 8 has a pipe shape and is fixed in a main body of the air gun 1. The barrel fixing portion 8 has an opening positioned at the side of the muzzle B. The pipe shaped opening has a diameter at which the barrel 6 is inserted into the opening. A load packing 9 is mounted in the side of the gun-rear end A of the barrel 6. Furthermore, the pipe shaped opening has a diameter at which a loading pipe 16 of a cylinder block described later is inserted, at the side of the gun-rear end A. The barrel 6 and the load packing 9 are inserted to be fixed at the side of the muzzle B. In addition, the loading pipe 16 of the cylinder block 15 is free from in and out of the opening at the side of the gun-rear end A.

10 represents a slide. The slide 10 is positioned on the gun from the muzzle B to the gun-rear end A parallel to the barrel 6 to slide along the barrel 6. The slide 10 is inserted into the outer barrel 7 to be constantly pushed, by the slide spring 11, toward the side of the muzzle B, where one end of the slide spring 11 is connected to the muzzle end of the slide 10 and whose other end is connected to the muzzle end of the gun 1. In addition, a stopper projection 12 is formed on an upper portion of the chamber 5 in the middle portion of the slide 10 and projects downwardly.

13 represents a piston block. At a basic portion of the gun-rear end A in a cylindrical shaped cylinder portion, the piston block 13 is fixed to the side of the gun-rear end A and the inside of the slide 10. The piston block 13 has the cylinder portion which is directed towards the side of the muzzle B. The piston block 13 slides together with the slide 10. Furthermore, the piston block 13 has a hammer contact portion 14 at a lower portion of the side of the gun-rear end A in the piston block 13. The hammer contact portion 14 is used as a contact projection which contacts the hammer 38, when the piston block 13 slides. The hammer contact portion 14 rotates the hammer 38 when it contacts the hammer 38.

15 represents a cylinder block. The cylinder block 15 has a loading pipe 16 of a hollow cylindrical shape at the side of the muzzle B of the cylinder block 15. The loading pipe 16 has an opening at the side of the muzzle B. A projection having a narrow width is mounted at a lower portion of the head in the side of the muzzle B of the loading pipe 16 so as to be inserted into the opening 4 formed on the upper portion of the magazine 2. The projection projects downwardly from the center portion when the projection is viewed from the side of the muzzle B. A cylinder portion 17 having a hollow cylindrical shape is formed at an opposite side of the loading pipe 16, namely, at the side of the gun-rear end A of the cylinder block 15. The cylinder portion 17 is integrally formed to the loading pipe 16 and has a diameter greater than that of the loading pipe 16. The cylinder portion 17 has an opening at the side of the gun-rear end A.

The piston block 13 is inserted into a hollow portion 18 of the loading pipe 16. The hollow portion 18 of the loading pipe 16 forms a bullet discharge ventilating opening 19. The bullet discharge ventilating opening 19 is opened to the load packing 9 at the side of the muzzle B.

The gun-rear end side of the cylinder portion 17 opens downwardly at a circumferential surface. A blow-back ventilating opening 20 is formed at a portion of the downwardly opening circumferential surface of the loading pipe 16 of the cylinder portion 17. The blow-back ventilating opening 20 makes the hollow portion 18 of the cylinder portion 17 communicate with the outside.

The cylinder block 15 formed as previously described is positioned between the piston block 13 and the load packing 9. When the cylinder block 15 moves as far as possible toward the side of the load packing 9, the end portion of the loading pipe 16 is inserted into the barrel fixing portion 8 at the side of the muzzle B to be positioned at the end of the load packing 9. In contrast, when the slide 10 slides towards the side of the gun-rear end A, the stopper projection 12 contacts the upper portion of the cylinder portion 17 on the muzzle B side thereof so that the cylinder block 15 is moved toward the gun-rear end A. Immediately after the head of the loading pipe 16, which is positioned at the side of the load packing 9, has been driven beyond the upper opening 4 of the magazine 2 (i.e., toward the side of the gun-rear end A), it is possible to load a bullet W from the upper opening 4 of the magazine 2 (and is positioned in the chamber 5) into the load packing 9, when the cylinder block 15 moves back towards the muzzle B.

In this embodiment, although the stopper projection 12 of the slide 10 is directed downwardly to engage with the cylinder block 15, the stopper projection 12 may be formed at a side surface of the slide 10 to engage with the cylinder block 15. In addition, a groove portion extending to a slide direction of the slide 10 may be formed on an inner surface of the slide 10. The cylinder block 15 may have a stopper projection which is slidably inserted in the groove portion formed on the slide 10 in order to carry out a mutual slide. When the slide 10 slides to the side of the gun-rear end A and reaches a predetermined position, the stopper projection formed on the cylinder block 15 may contact the end portion of the groove portion formed in the slide 10. After this contact, the cylinder block 15 may slide to the side of the gun-rear end A while sliding with the slide 10. Any stopping relationship may be adopted on condition that the cylinder block 15 slides with the sliding of the slide 10.

21 represents a change valve gas chamber. The change valve gas chamber 21 is formed at a lower portion of the cylinder block 15. An upper portion of the change valve gas chamber 21 is positioned at the lower portion of the cylinder block 15. The change valve gas chamber 21 has a bullet air-supply opening 22 at a position opposite to the bullet discharge ventilating opening 19 of the cylinder block 15.

The change valve gas chamber 21 has a blow-back air-supply opening 23 at a position opposite to the blow-back ventilating opening 20. The bullet air-supply opening 22 and the blow-back air-supply opening 23 are opposite openings, respectively, at the lower portion of the cylinder block 15. The opposite openings are adjacent to each other.

The bullet air-supply opening 22 and the blow-back air-supply opening 23 are separated by a partition 24. Furthermore, a stopper projection 25 is mounted at a side of the bullet air-supply opening 22 in the head of the partition 24. Furthermore, an air-supply opening 26 is formed at the lower portion of the change valve gas chamber 21. The air-supply opening 26 is opened to the side of the gun-rear end A.

When the bullet air-supply opening 22 and the blow-back air-supply opening 23 are closed by a change valve which will be described later (to supply no compressed gas to the blow-back ventilating opening 20), the bullet air-supply opening 22 and the blow-back air-supply opening 23 are closed on a soft synthetic resin which enhances a closing condition between the change valve 34 and the bullet air-supply opening 22 and the blow-back air-supply opening 23.

If it is necessary to achieve an air-tight closing condition, it is necessary to smooth contact portions between the change valve 34 and the bullet air-supply opening 22 and the blow-back air-supply opening 23. Furthermore, it is necessary to use a more soft rubber material in the change valve 34, the bullet air-supply opening 22, and the blow-back air-supply opening 23, taking each material into consideration. Namely, it may be necessary to select a material which satisfies a necessary condition. Further, it may be necessary to select a finish which satisfies a necessary condition. In addition, where it is not necessary to achieve the air-tight closing condition, it is possible to reduce cost by using a rigid synthetic resin.

27 represents a compressed gas chamber. The compressed gas chamber 27 is formed at the lower portion of the change valve gas chamber 21 in the grip portion C. A check valve 28 is mounted at a bottom portion of the compressed gas chamber 27, namely, at a bottom of the grip portion C. The check valve 28 is for supplying the compressed gas to the compressed gas chamber 27. The check valve 28 supplies the compressed from a gas cylinder (not shown) to the compressed gas chamber 27. The compressed gas chamber 27 does not exhaust the compressed gas held therein to the outside. In addition, an exhaust opening 29 is formed at an upper portion of the compressed gas chamber 27.

The exhaust opening 29 is connected to the air-supply opening 26 of the change valve gas chamber 21 with an air-tight condition. As a result, the compressed gas in the compressed gas chamber 27 is exhausted from the exhaust opening 29 to the change valve gas chamber 21. Therefore, it is possible for the exhaust opening 29 to supply the compressed gas supplied from the compressed gas chamber 27 to the bullet air-supply opening 22 or to blow-back air-supply opening 23 to the cylinder block 15.

30 represents an open-close valve. The open-close valve has an open-close valve main body 31 whose head has a shape for closing the air-supply opening 26. At another end, the open-close valve has a valve head 32 pushed by a hammer which will be described later. The open-close valve main body 31 is positioned in the change valve gas chamber 21. Adjacent the exhaust opening 29 of the compressed gas chamber 27, the valve head 32 is positioned toward the gun-rear end A and is positioned outside the compressed gas chamber 27. The open-close valve 30 is constantly pushed towards the side of the gun-rear end A by a valve spring 33 to close the exhaust opening 29. When the valve head 32 is pushed, the open-close valve 30 slides to the side of the change valve gas chamber 21 to open the exhaust opening 29. As a result, the compressed gas in the compressed gas chamber 27 is supplied to the change valve gas chamber 21.

34 represents a change valve. As shown in FIG. 16, the change valve 34 has a head portion which is exposed in the change valve gas chamber 21. The change valve 34 further has a closing portion 35 for closing the blow-back air-supply opening 23. A rod portion 36 extends from the closing portion 35 to the side of the gun-rear end A. The rod portion 36 has a strength such that the rod portion 36 slides the closing portion 35 and the rod portion 36 is formed to a fine bar shape in comparison to the closing portion 35. It is possible for the closing portion 35 to slide so as to close the blow-back air-supply opening 23. In addition, it is possible for the closing portion 35 to slide so as to close the bullet air-supply opening 22 opened adjacent to the blow-back air-supply opening 23.

The change valve 34 is constantly pushed towards the gun-rear end A by a valve spring 37. A first end of the valve spring 37 is supported to the main body of the air gun 1 at a position opposite to the closing portion 35 of the rod portion 36. Another end of the valve spring 37 is attached to the rod portion 36. Therefore, the change valve 34 has an initial state during which the closing portion 35 closes the blow-back air-supply opening 23.

When the compressed gas supplied from the air-supply opening 26 of the change valve gas chamber 21, during the initial state, is exhausted through the bullet air-supply opening 22 to the side of the muzzle B, the pressure becomes negative at the side surface of the bullet air-supply opening 22 of the closing portion 35. By the pressure becoming "negative," it is meant that the pressure is substantially reduced. As a result, it is possible for the change valve 34 to slide against the applied force of the valve spring 37. On sliding against the applied force, the closing portion 35 contacts the stopper projection in the change valve gas chamber 21 to stop sliding. As a result, the change valve 34 opens the blow-back air-supply opening 23 and closes the bullet air-supply opening 22.

Upon closing the bullet air-supply opening 22 and opening the blow-back air-supply opening 23 (each of which is a supply path of the compressed gas, as previously described), the rod portion 36 is exposed in the change valve gas chamber 21 along with the closing portion 35 of the change valve 34. Therefore, it is possible to reduce a ventilating resistance in the change valve gas chamber 21 which is for use in a ventilating path of the compressed gas.

38 represents a hammer. The hammer 38 has a plate body of a fan shape. An axis portion 39 is formed at the portion corresponding to the rivet of the fan. The hammer 38 is rotatably attached to the main body of the air gun 1 by the axis portion 39. In this embodiment, the axis portion 39 is mounted in the gun-rear side end A of the air gun 1 at about the center of the transverse direction, on viewing the axis portion 39 from the side of the muzzle B.

The hammer 38 is pushed by a hammer spring (not shown) so as to rotate constantly towards the muzzle B around the axis portion 39. In addition, a blowing portion 40 is mounted at the side of the muzzle B in the hammer 38 to project to the side of the muzzle B. The blowing portion 40 blows the valve head 32 of the open-close valve 30 when the hammer 38 is rotated away from the side of the gun-rear end A and towards the side of the muzzle B, in response to the force of the hammer spring (not shown).

A stopper portion 41 extends upwardly from the fan shape of the hammer 38. The stopper portion 41 contacts the hammer contact portion 14 and rotates towards the side of the gun-rear end A, when the piston block 13 (positioned above the hammer 38) slides towards the side of the gun-rear end A. When the hammer contact portion 14 of the piston block 13 rotates towards the side of the gun-rear end A, the stopper portion 41 rotates the hammer 38 towards the side of the gun-rear end A. As a result, the hammer contact portion 14 moves towards the side of the gun-rear end A beyond the contact portion 41 thereby engaging a sear 47.

When the hammer contact portion 14 passes the stopper portion 41, the stopper portion 41 rotates towards the side of the muzzle B at the attach portion independent of the hammer 38. As a result, it is subsequently possible for the hammer contact portion 14 to slide back towards the side of the muzzle B beyond the stopper portion 41 without moving the position of the hammer 38.

42 represents a sear stopper pin. The sear stopper pin 42 projects from the fan shape surface of the hammer 38 to engage with the sear portion 47. When the sear stopper pin 42 engages with the sear portion 47, the sear stopper pin 42 maintains a state at which the hammer 38 rotates towards the side of the gun-rear end A. Therefore, the hammer 38 is rotated towards the side of the gun-rear end A by the hammer contact portion 14 against the force of the hammer spring (not shown) so that the sear stopper pin 42 engages with the sear portion 47.

When the sear stopper pin 42 is released from the sear portion 47, the hammer 38 is rotated towards the side of the muzzle B by the force of the hammer spring (not shown) so that the blowing portion 40 contacts and drives the valve head 32 of the open-close valve 30. As a result, the open-close valve 30 changes to the opening state. When the blow portion 40 is adjacent the end of the valve head 32 of the open-close valve 30 when the hammer is no longer being rotated towards the side of the gun-rear end A, the force applied by the hammer 38 is no longer strong enough to force open the open-close valve 30. Accordingly, the open-close valve 30 returns to the closing state by an own force (i.e., by the force of the valve spring 33).

43 represents a trigger. The trigger 43 projects from the lower portion of the barrel fixing portion 8 of the air gun 1 to the lower outside portion of the air gun 1. A base portion of the trigger 43 is rotatably attached to the air gun 1 by an axis 44. Using the axis 44 as a rotating center, the base portion of the trigger 43 is always pushed to the side of the muzzle B. The trigger 43 is rotated towards the side of the gun-rear end A against the applied force by a user.

45 represents a trigger bar. The trigger bar 45 is positioned from the trigger 43 to the hammer 38. One end of the trigger bar 45 is rotatably connected to the upper portion of the trigger 43. As the trigger 43 is rotated towards the side of the gun-rear end A, the trigger bar 45 moves towards the side of the gun-rear end A. A sear pushing projection 46 for pushing the sear portion 47 towards the gun-rear is mounted at the end of the trigger bar 45 in the side of the hammer 38. The sear pushing projection 46 projects towards the side of the air gun 1.

47 represents a sear portion. The sear portion 47 consists of a first sear 48 and a second sear 49. The first sear 48 is pushed by the trigger bar 45. The second sear 49 engages with the sear stopper pin 42 of the hammer 38. The first sear 48 is mounted on the air gun 1 to rotate around a rotating axis 50 positioned at a lower end. As shown in FIG. 15(*c*), the first sear 48 has rectangle body when the first sear is viewed from the side direction. The upper portion of the rectangle body is opened. The rectangle body has shape comprising walls 51 and 52 opposite to each other. A second sear stopper portion 53 is formed at the upper portion of the wall 51 with a portion missing which faces to the side of the muzzle B. In addition, a trigger bar stopper portion 54 is formed at a middle portion of the wall 52 and projects towards the side of the gun-rear end A. The head of the trigger bar stopper portion 54 is bent towards the outside. The first sear 48 is constantly pushed towards the side of the muzzle B.

The trigger bar stopper portion 54 is positioned opposite to the sear pushing projection 46 of the trigger bar 45. The sear pushing projection 46 prevents the first sear 48 from rotating towards the side of the muzzle B. When the trigger bar stopper portion 54 is pushed by the sear pushing projection 46 of the trigger bar 45, the first sear 48 rotates towards the side of the gun-rear end A around the rotating axis 50.

The second sear 49 is positioned next to the hammer 38 in the opening of the first sear 48. The second sear 49 is attached to the air gun 1 so as to be able to rotate around the rotating axis 55 of the gun-rear end A.

A hammer stopper groove 56 is formed at the middle portion of the second sear 49 to engage with the sear stopper pin 42 formed on the hammer 38. The sear stopper pin 42 engages with the hammer stopper groove 56. Furthermore, a first sear stopper portion 57 is formed at an rotating end of the second sear 49 to project towards the side of the air gun 1. The first sear stopper portion 57 is able to engage with the second sear stopper portion 53 of the first sear 48.

The second sear 49 is constantly pushed upward so as to be able to rotate around the rotating axis 55. However, when the hammer 38 is greatly pushed towards the side of the muzzle B, the sear stopper pin 42 is pushed towards the side of the muzzle. As a result, the second sear 49, which is constantly pushed upward with a rotational state, rotates downwardly against the upward applied force on the basis of an angle which is slightly slanted to the side of the muzzle B. The angle is formed at the side surface of the groove portion which engages with the sear stopper pin 42 of the hammer stopper groove 56.

On the other hand, when the first sear stopper portion 57 of the second sear 49 engages with the second sear stopper portion 53 formed on the first sear 48, the second sear 49 is prevented from rotating downwardly. When the trigger bar stopper portion 54 of the first sear 48 is pushed towards the gun-rear end A by the sear pushing projection 46 of the trigger bar 45, the second sear stopper portion 53 of the first sear 48 is released from the first sear stopper portion 57 of the second sear 49. As a result, the second sear 49 is rotated downwardly around the rotating axis 55.

Figure 7:
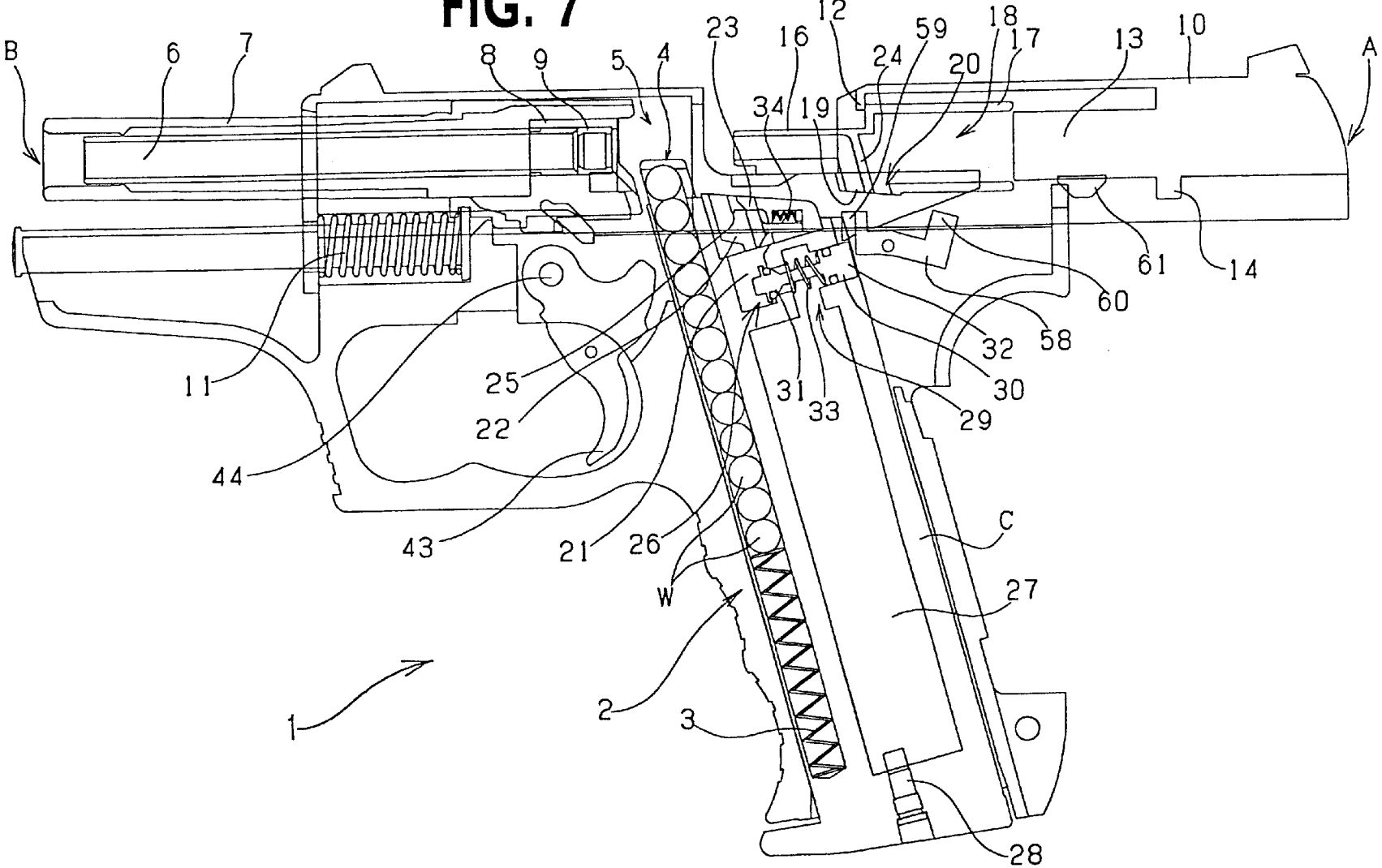

58 represents a wobble member. As shown in FIG. 7, the wobble member 58 is positioned on this side of the hammer 38. The wobble member 58 wobbles at its center which is used as a wobble center. The wobble member 58 is mounted on the gun-rear end A side of the open-close valve 30 and is positioned in a transverse direction. A valve stopper portion 59 is mounted on the muzzle B side of the wobble member 58. The wobble member 58 is pushed by a spring (not shown) so that the valve stopper portion 59 always rotates downwardly.

When the open-close valve 30 closes the change valve gas chamber 21, valve stopper portion 59 is positioned at the upper portion of the valve head 32 of the open-close valve 30 which projects to the side of the gun-rear end A. The valve stopper portion 59 engages with the valve head 32 of the open-close valve 30 without holding the open-close valve 30.

In the case where the open-close valve 30 moves towards the side of the gun-rear end A to change to the opening state, the valve head 32 moves towards the side of the muzzle B. As a result, the valve stopper portion 59 moves downwardly by the applied force to engage with the valve head 32. Therefore, it is possible to prevent the open-close valve 30 from returning back to the side of the gun-rear end A by the applied force.

In addition, a wobble projection 60, which projects to this side, is mounted on the side end of the gun-rear end A of the wobble member 58. When the slide 10 slides to the side of the gun-rear end A, the wobble projection portion 60 is pushed by a stopper projection 61 which is fixed in the side surface on this side of the slide 10 in FIG. 7 and which projects to the side of the opposite side surface. As a result, the wobble projection portion 60 is rotated downwardly against the applied force. The valve stopper portion 59 rotates upwardly to be released from the valve head 32 of the open-close valve 30.

Next, description will be made as regards an operation of the embodiment previously described.

In the initial state, the bullet W is not loaded in the load packing 9 as shown in FIGS. 2 and 3. The open-close valve 30 is in the closing state although the hammer 38 is rotated away from the gun-rear end A and the blow portion 40 is in contact with the valve head of the open-close valve 30.

A bullet W is loaded in the load packing 9 according to the following protocol. To carry out a preparation of the bullet discharge, the slide is slid towards the gun-rear end A against the force of the slide spring 11, as shown in FIGS. 2 and 3. At that time, the piston block 13 fixed on the gun-rear end A side of the slide 10 is also slid towards the side of the gun-rear end A. Soon, the stopper projection 12 of the slide 10 contacts the muzzle B side of the cylinder block 15 so that it also slides towards the gun-rear end A, as shown in FIG. 4.

Figure 5:
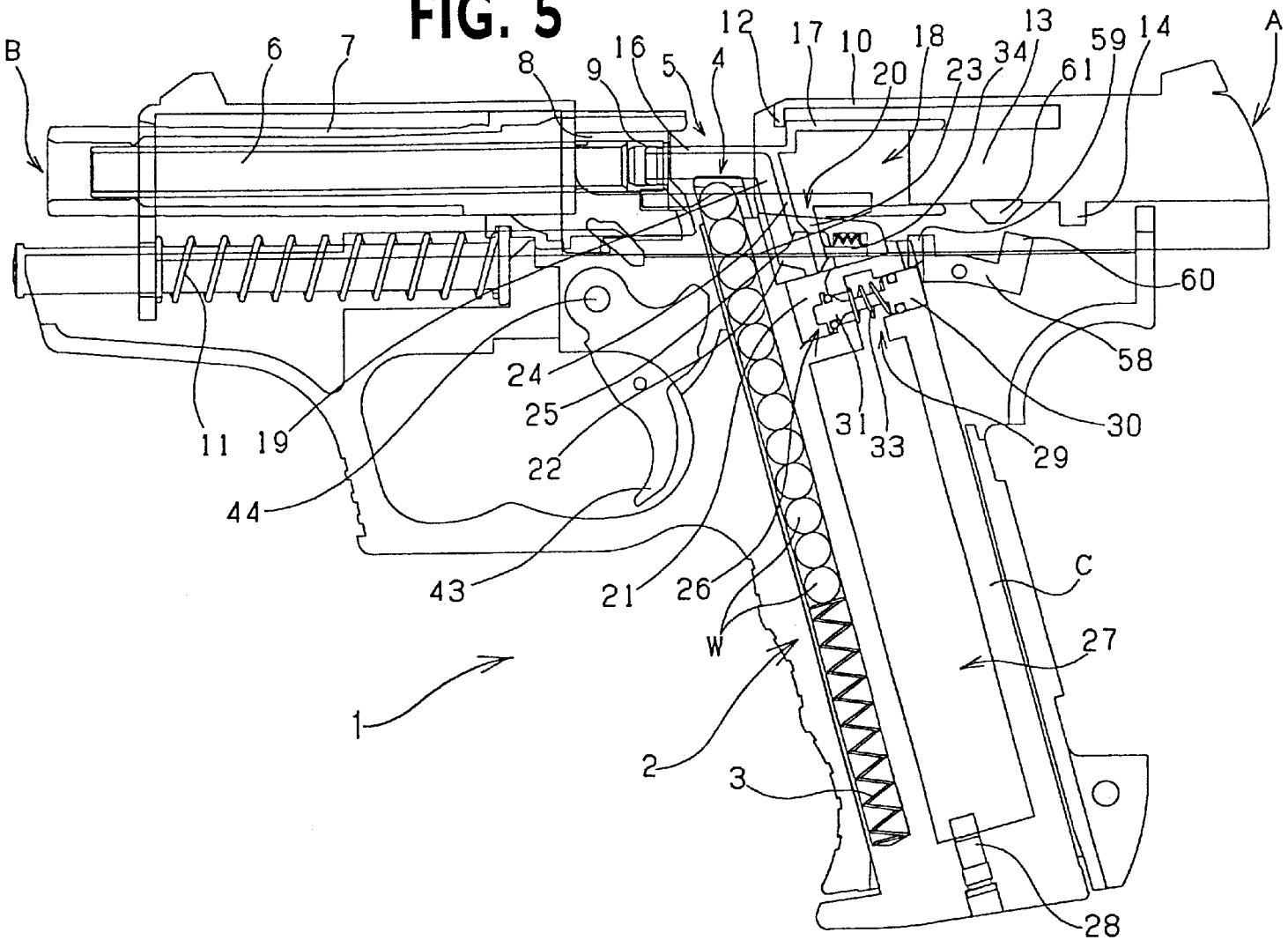

When the piston block 13 is slid towards the gun-rear end A, the hammer contact portion 14 of the piston block 13 contacts the stopper portion 41 of the hammer 38 and rotates the hammer 38 toward the gun-rear end A against the applied force. Similarly, the stopper projection 61 fixed on the inner surface of the slide 10 pushes the wobble projection portion of the wobble member 58 to move towards the gun-rear end A beyond the wobble projection 60 of the wobble member 58, as shown in FIG. 5. As a result, the wobble member 58 is rotated towards the gun-rear end A. In this condition, the open-close valve is in the closing state.

Figure 4:
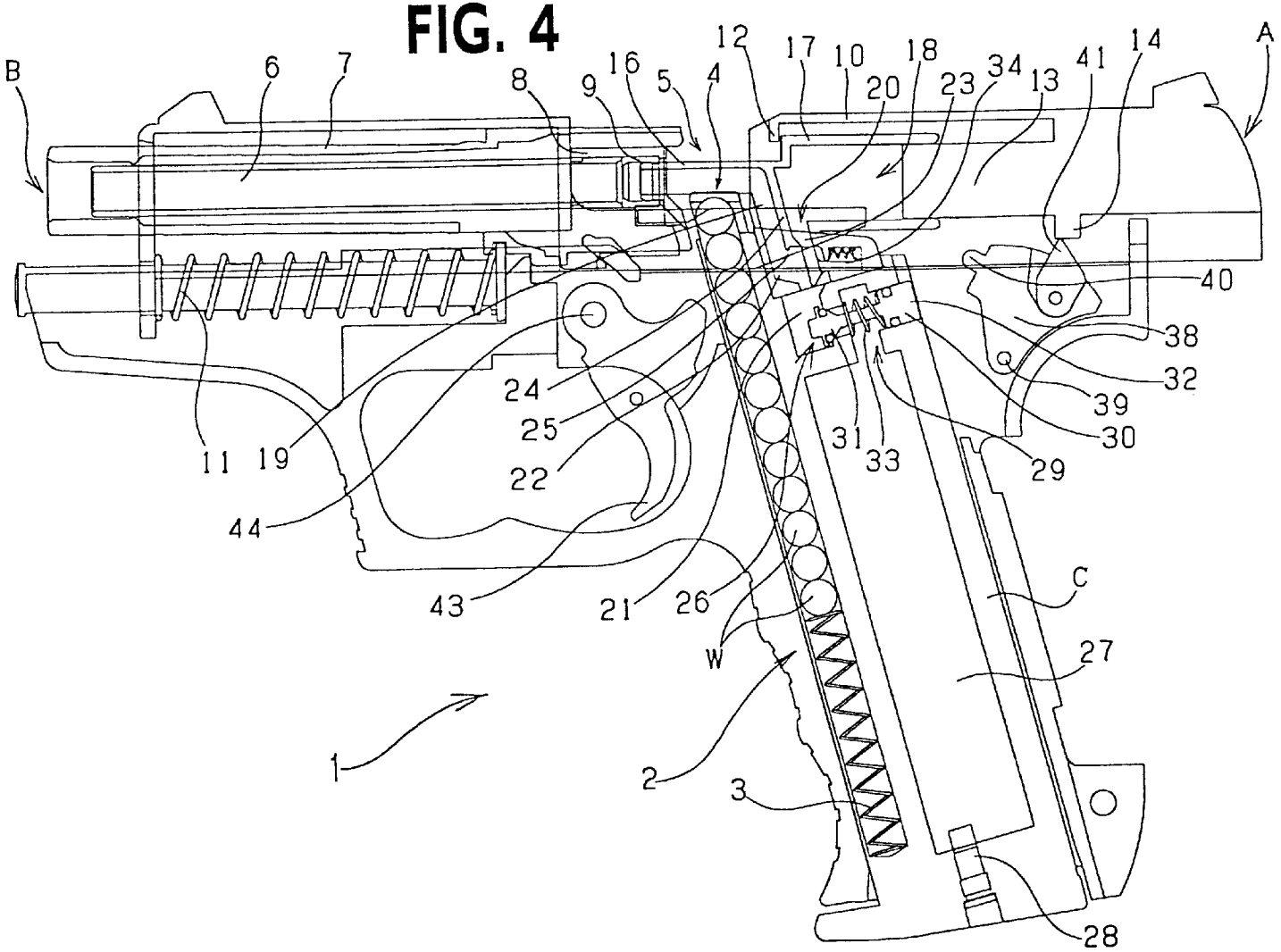
FIGS. 4 to 13 show views for describing an operation of an embodiment of this invention.

FIG. 4 shows a sectional view of the hammer 38 to aid in readily understanding the operation of the hammer 38. FIG. 5 shows a sectional view of the wobble member 58 to aid in readily understanding the operation of the wobble member 58.

Figure 6:
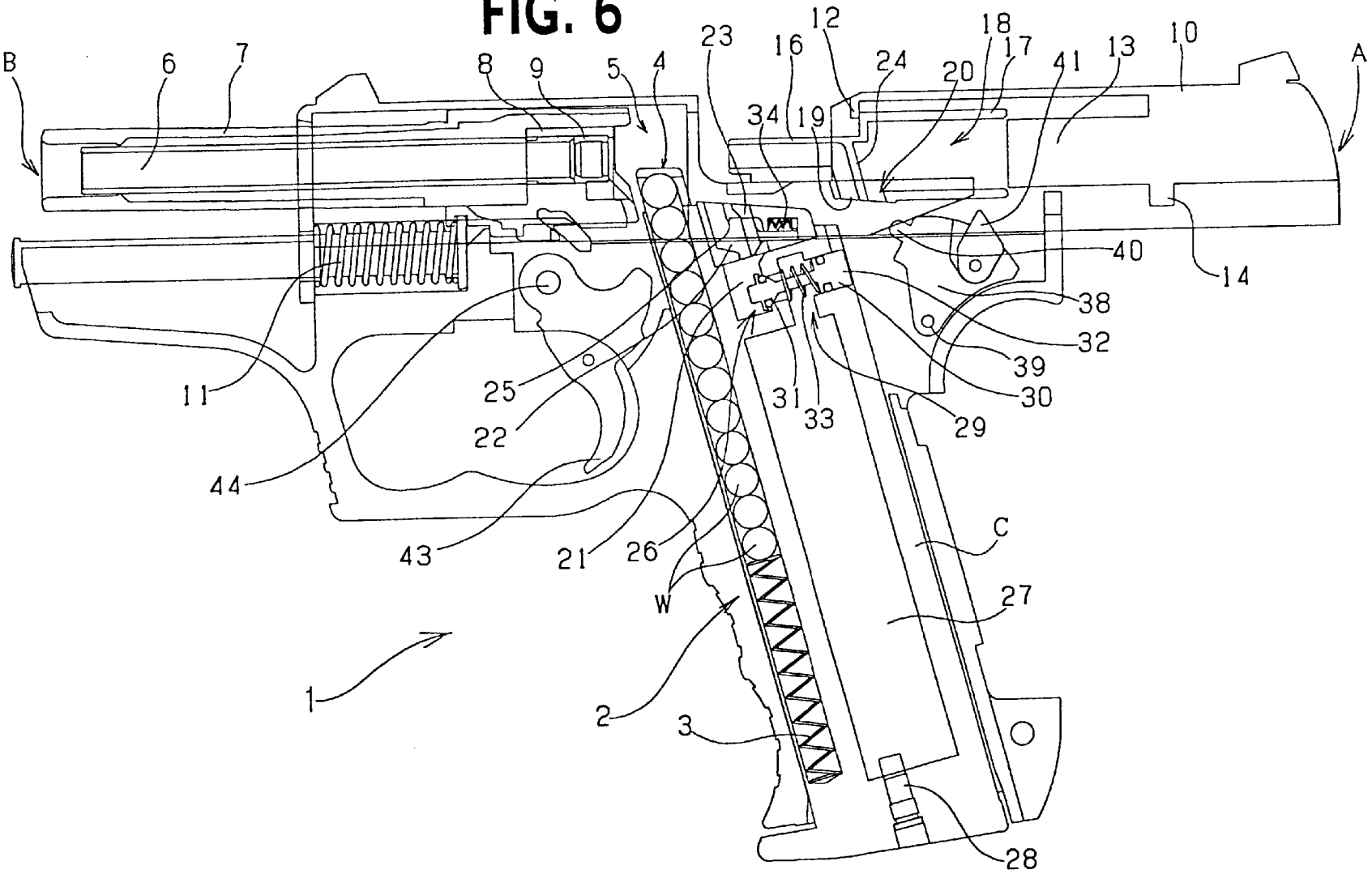

As shown in FIG. 6, the slide 10 slides towards the side of the gun-rear end A as far as possible. In this condition, the head of the muzzle side B of the loading pipe 16 mounted on the cylinder block 15 is moved to the gun-rear end A beyond the upper portion of the opening 4 of the magazine 2 (which is now opened in the chamber 5). Therefore, an uppermost bullet W is driven to the top of the opening 4. At that time, the hammer 38 is rotated towards the gun-rear end A so that the sear stopper pin 42 of the hammer 38 engages with the hammer stopper groove 56 of the second sear 49. The hammer 38 is rotated towards the gun-rear end A such that a potential energy is stored in the hammer 38; the potential energy will be converted to a force when the hammer 38 rotates towards the side of the muzzle B.

Similarly, the stopper projection 61 also moves towards the gun-rear end A beyond the wobble member 58 as shown in FIG. 7. The valve stopper portion 59 of the wobble member 58 does not engage with the valve head 32 of the open-close valve 30. The slide spring 11 is expanded by the slide 10.

Next, when the slide 10 finishes sliding towards the gun-rear end A as shown in FIGS. 6 and 7, the slide 10 slides back towards the side of the muzzle B in response to the force of the slide spring 11. As a result, the air gun enters the state shown in FIG. 8.

Figure 8:
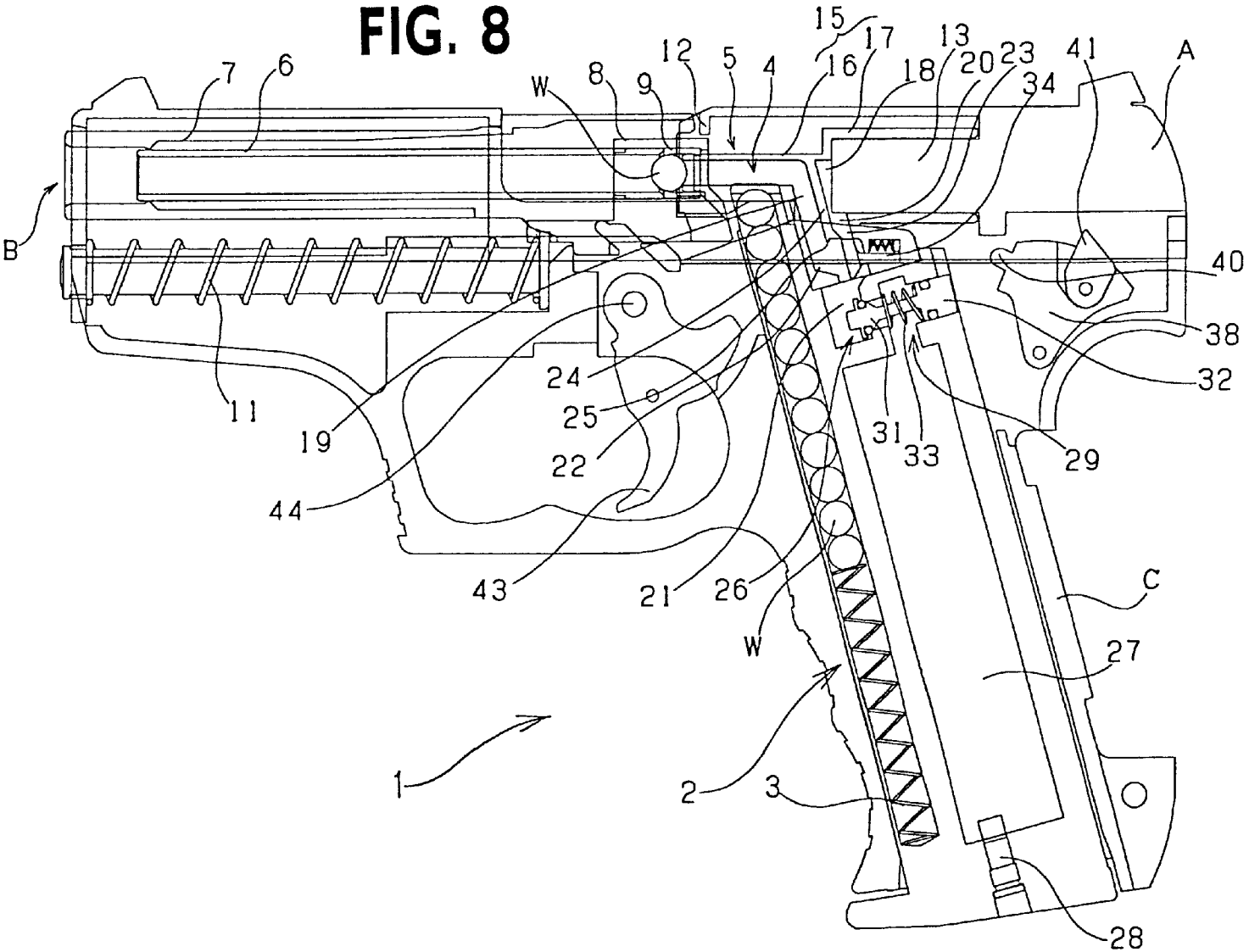

In the processes of transitioning from FIGS. 6 to 8, the projection, which is formed at the lower portion of the head of the loading pipe 16 mounted on the cylinder block 15, moves the bullet W positioned at the uppermost portion of the opening 4 in the magazine 2, from the opening 4 to the chamber 5. Soon, the bullet W is loaded in the load packing 9 as shown in FIG. 8. Therefore, the bullet W is loaded, the hammer is set in the state shown in FIG. 8; and the preparation of the bullet discharge is finished.

Next, the trigger 43 is pulled from the state of the FIG. 8. Namely, the trigger 43 is moved in the direction of arrow 1 shown in FIG. 14. Further, while the trigger 43 moves in the direction of arrow 1, the trigger bar 45 moves in the direction of arrow 2, the sear portion 47 moves in the direction of arrows 3 and 4, and the hammer 38 moves in the direction of arrow 5, as shown in FIG. 14. As a result, the hammer 38 is released from the sear portion 47 and rotates towards the side of the muzzle B on the basis of the potential energy stored therein, as later described in detail.

When the trigger 43 rotates towards the gun-rear end A, the trigger bar 45 moves towards the side of the gun-rear end A in synchronization with the trigger 43. As a result, the sear pushing projection 46 of the trigger bar 45 pushes the trigger bar stopper portion 54 of the first sear 48 towards the gun-rear end A. Further, the first sear 48 rotates towards the gun-rear end A around the rotating axis 49 so that the second sear stopper portion 53 of the first sear 48 is released from the first sear stopper portion 57 of the second sear 49. As described above, the second sear 49 is released from the first sear 48.

When the sear stopper pin 42, which engages with the hammer stopper groove 56, pushes the hammer stopper groove 56 towards the side of the muzzle B by the applied force of the hammer 38, the head of the second sear 49 that is positioned at the side of the muzzle B is rotated downwardly. Soon, the sear stopper pin 42 disengages the hammer stopper groove 56. The hammer 38 rotates towards the side of the muzzle B with a gush on the basis of the own applied force so that the blowing portion 40 of the hammer 38 impacts the valve head 32 of the open-close valve 30, as shown in FIG. 9.

Figure 9:
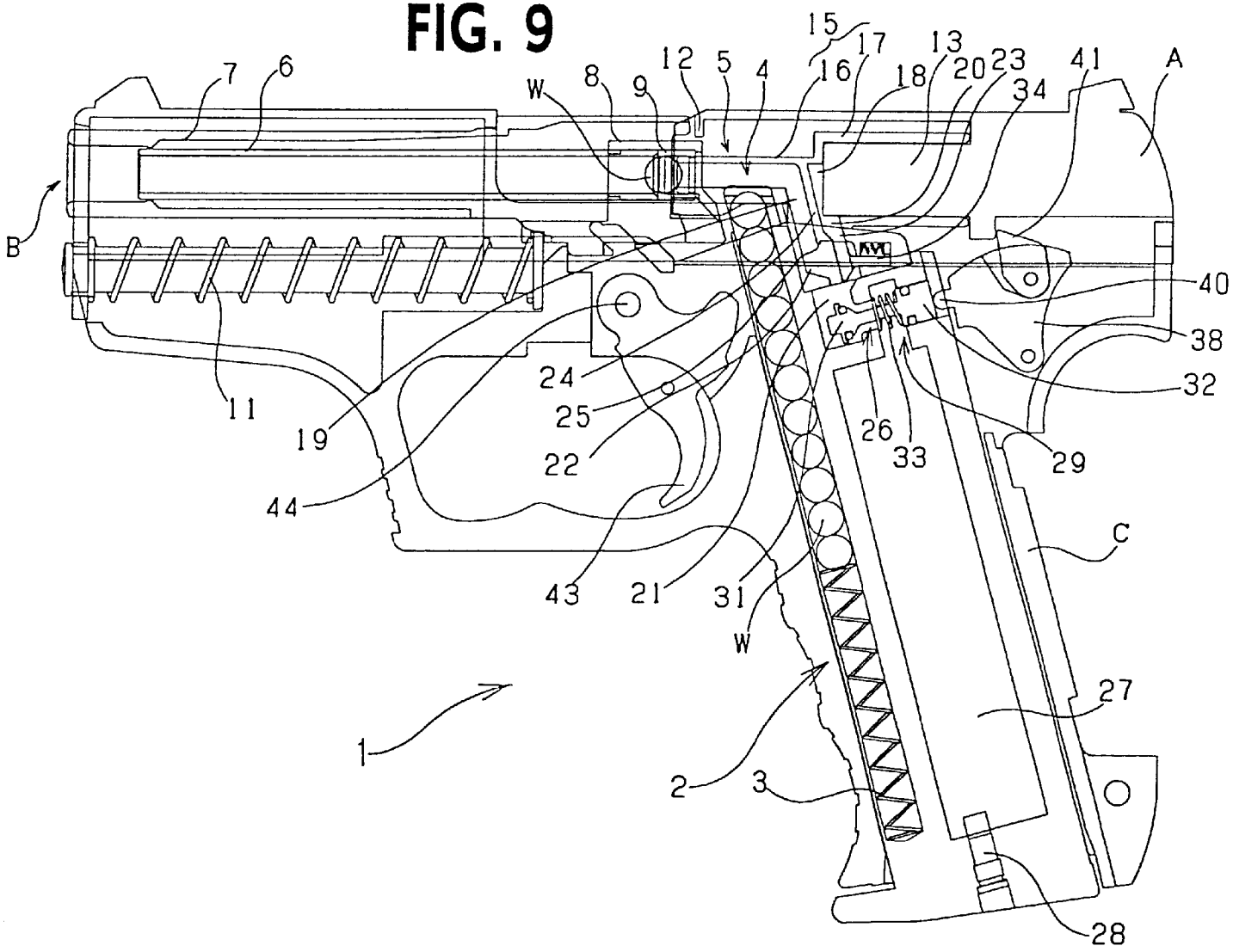
Figure 10:
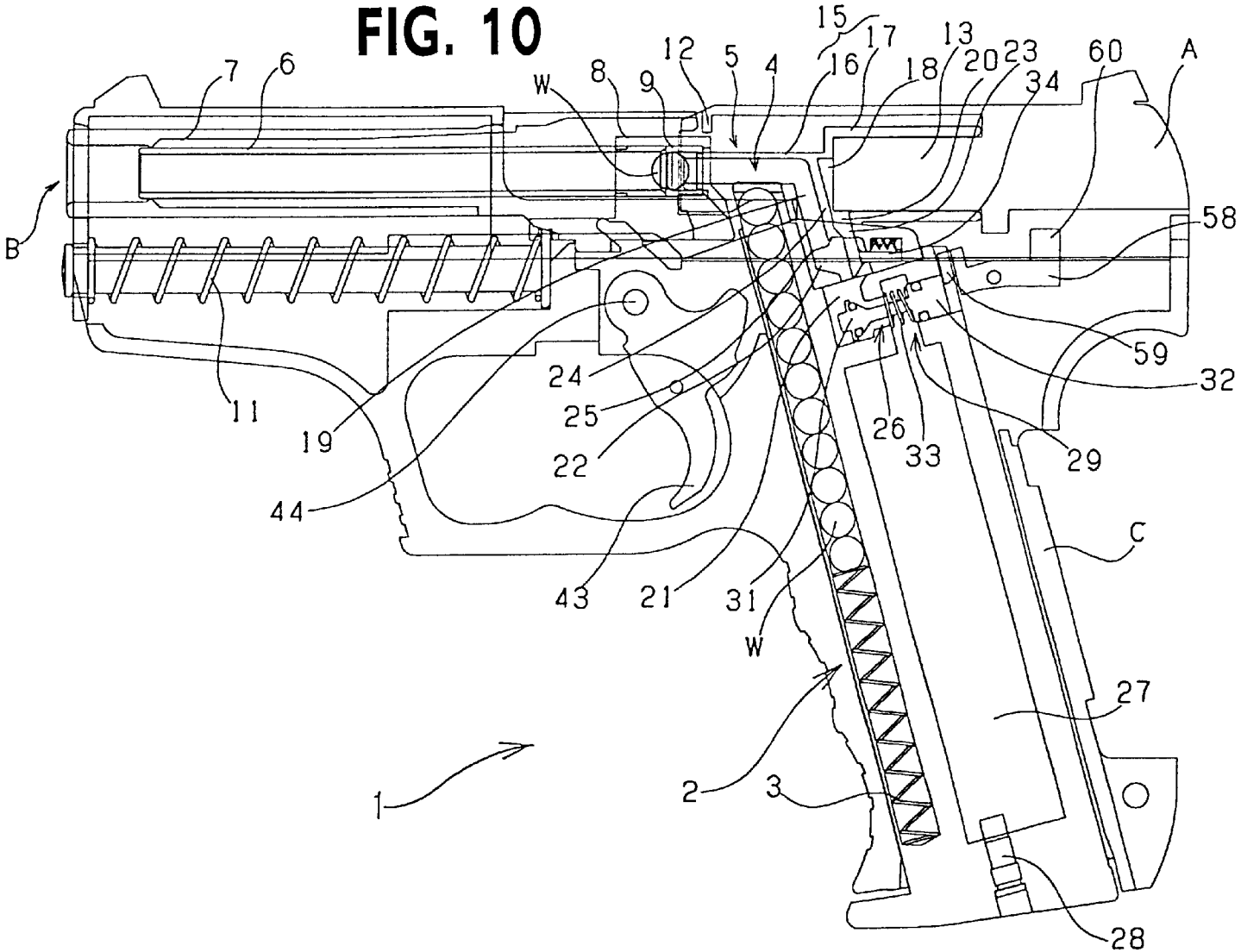

In the condition of FIG. 9, the open-close valve 30 changes to the opening state, when the hammer 38 impacts the valve head 32 of the open-close valve 30. The opening of the open-close valve 30, in turn, changes the air-supply opening 26 of the change valve gas chamber 21 to the opening state. When the open-close valve 30 is slid towards the side of the muzzle B as shown in FIG. 10, the valve stopper portion 59 rotates downwardly on the basis of the force applied from the wobble member 58. As a result, the wobble member 58 also engages with the valve head 32 of the open-close valve 30 and the open-close valve 30 is maintained in the opening state.

When the open-close valve 30 is in the opening state, the compressed gas held in the compressed gas chamber 27 is supplied from the exhaust opening 29 of the compressed gas chamber 27 to the change valve gas chamber 21 through the air-supply opening 26 of the change valve gas chamber 21. Furthermore, the compressed gas is supplied to the loaded bullet W from the bullet air-supply opening 22 opened at the change valve gas chamber 21, through the bullet discharge ventilating opening 19 of the loading pipe 16. As a result, the bullet W is discharged from the muzzle B with a gush by the pressure of the compressed gas through the barrel 6.

When the bullet W is discharged from the muzzle B, the supplied compressed gas is instantly released from the muzzle B. As a result, the pressure in the front surface of the closing portion 35 of the change valve 34 is greatly reduced. In turn, the change valve 34 is moved towards the side of the muzzle B in response to the reduction in pressure. Namely, the closing portion 35 is moved so as to close the bullet air-supply opening 22. When the closing portion 35 closes the bullet air-supply opening 22, it opens the blow-back air-supply opening 23, as shown in FIG. 12.

When the bullet air-supply opening 22 is closed and the blow-back air-supply opening 23 is opened, the compressed gas chamber 27 is supplied from the change valve gas chamber 21 to the hollow portion 18 of the cylinder block 15 through the blow-back air-supply opening 23 and the blow-back ventilating opening 20. In the hollow portion 18, the piston block 13 in the cylinder block 15 starts to move towards the side of the gun-rear end A in response to the increase in pressure caused by the compressed gas in the hollow portion 18, as shown in FIG. 13.

Figure 12:
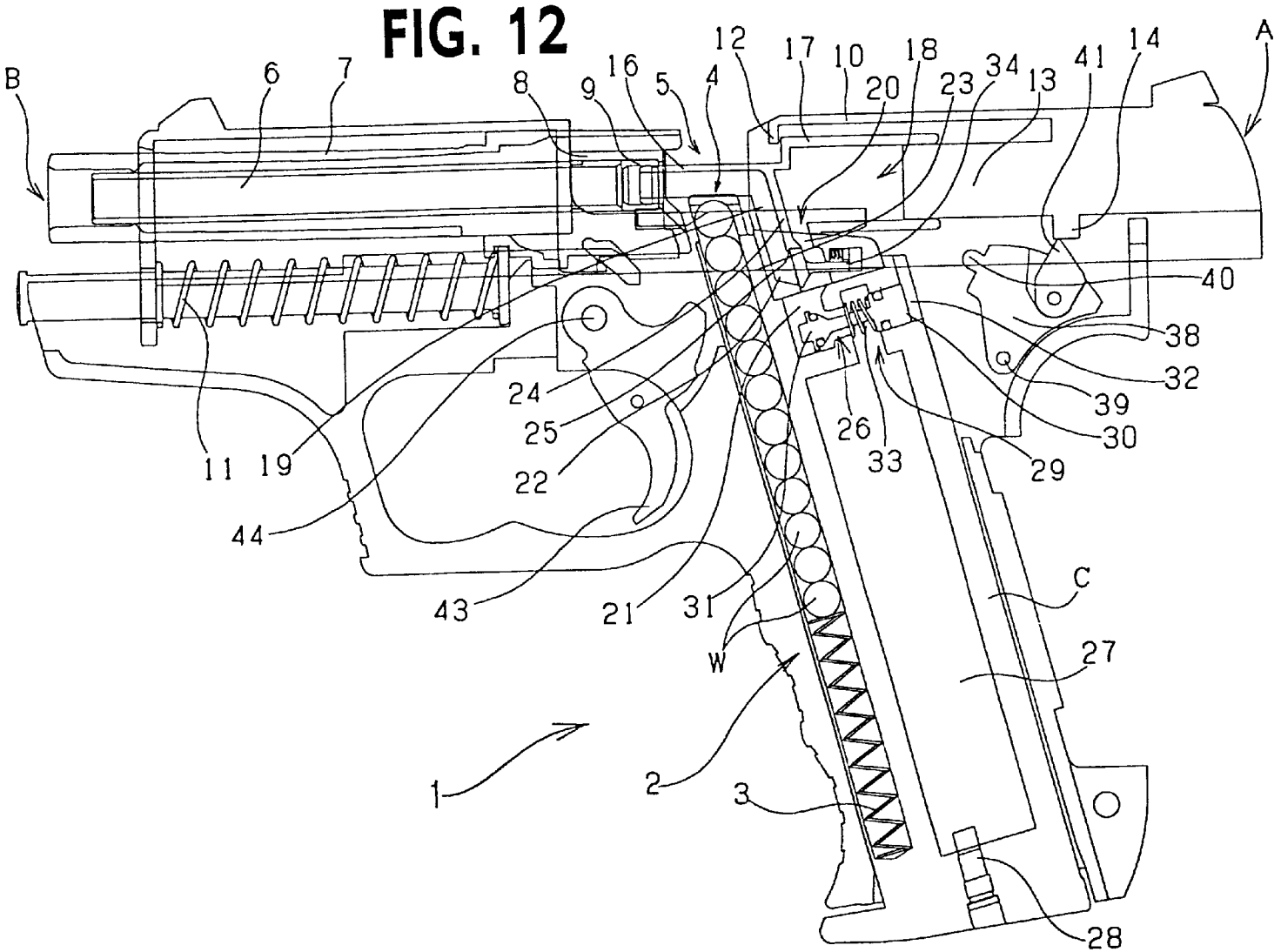
Figure 13:
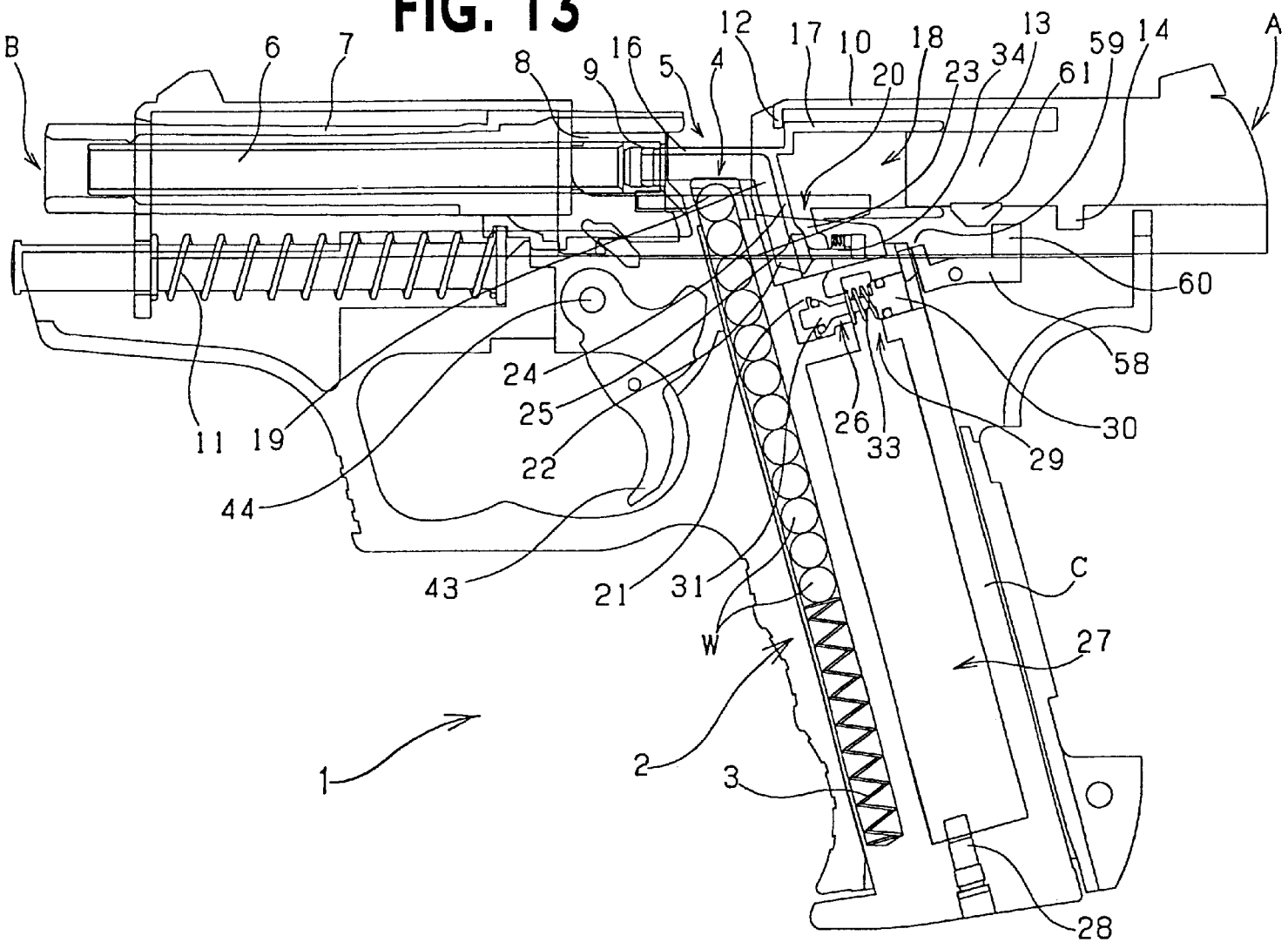

FIGS. 12 and 13 show views for describing an operation on the way in which the slide slides as far as possible towards the gun-rear end A. Furthermore, FIGS. 12 and 13 show views for illustrating a condition in which the stopper projection 61 pushes the wobble projection portion 60 of the wobble member 58 that closes the open-close valve 30, to carryout the wobble of the wobble projection portion 60.

Figure 11:
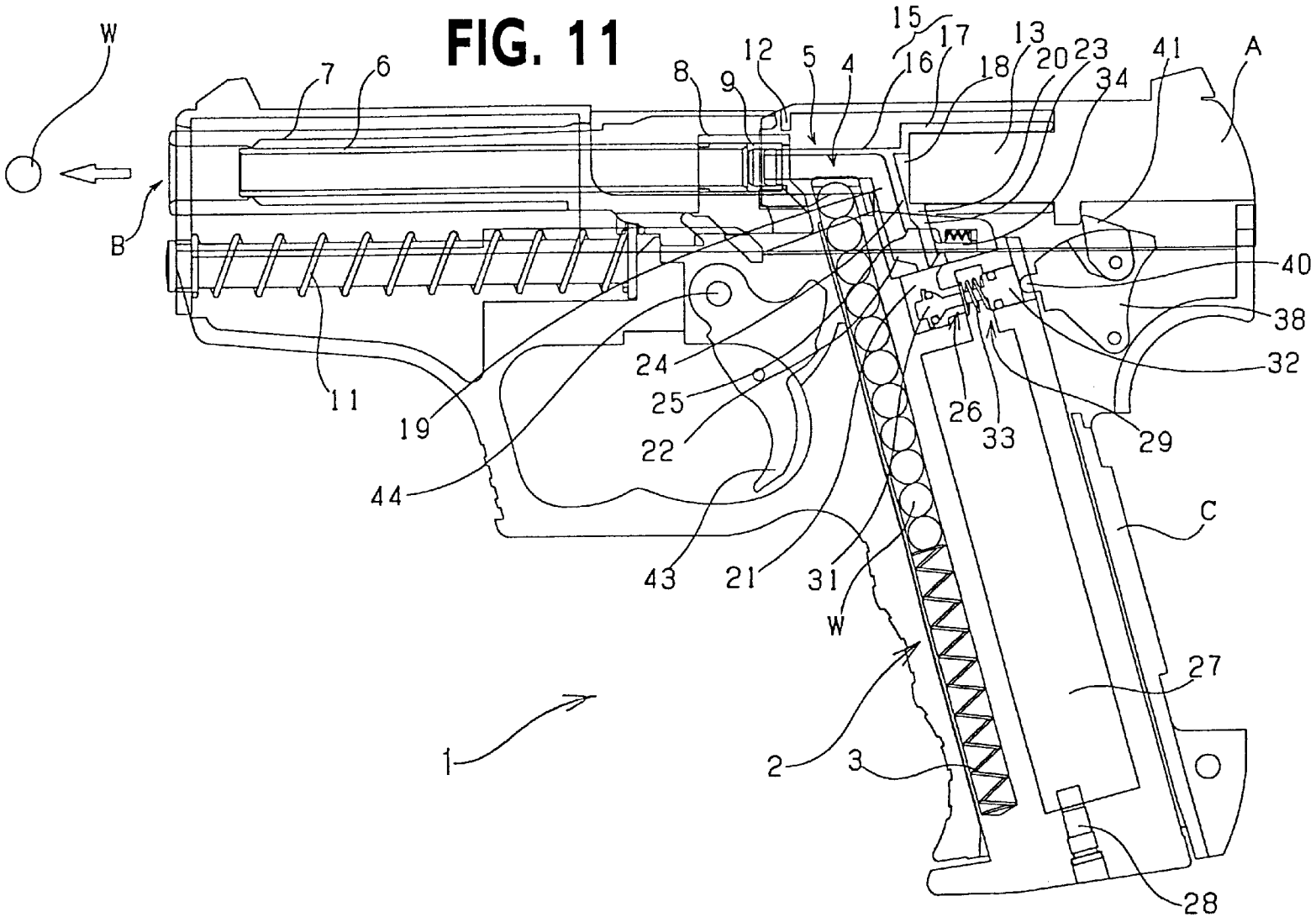

In transition from the state shown in FIG. 11 to the state shown in FIGS. 12 and 13, the slide 10 is slid as the piston block 13 slides towards the side of the gun-rear end A. The stopper projection 12 of the slide 10 contacts the the muzzle B side of the cylinder portion 17. The cylinder block 15 starts to slide towards the gun-rear end A as the slide 10 slides. In addition, when the piston block 13 is slid towards the gun-rear end A, the hammer contact portion 14 of the piston block 13 contacts the stopper portion 41 of the hammer 38, as shown in FIG. 11. As a result, the hammer 38 starts to rotate towards the gun-rear end A against the applied force.

As shown in FIG. 12, the hammer 38 is rotated towards the gun-rear end A. The hammer 38 engages with the sear portion 47 and is maintained in this state.

Similarly, the stopper projection 61 fixed on the inner surface of the slide 10 starts to push the wobble projection portion of the wobble member 58, as shown in FIG. 13. As a result, the wobble member 58 is rotated towards the gun-rear end A. The stopper projection 60 starts to release the open-close valve 30 from the wobble member 58. Soon, the slide 10 moves as far as possible towards the gun-rear end A to attain a condition similar to that of FIGS. 6 and 7.

The open-close valve 30 is released from the wobble member 58 in a condition similar to that of FIG. 7. As a result, the open-close valve 30 changes to the closing state. When the blow-back ventilating opening 20 changes to the opening state, the compressed gas supplied in the cylinder portion 17 leaks from the hollow portion 18 of the cylinder portion 17. In addition, inasmuch as the slide perfectly moves towards the side of the gun-rear end A, no inertia exists and the slide 10 starts to move towards the side of the muzzle B on the basis of the force of the slide spring 11.

As no compressed gas is supplied and the pressure in the change valve gas chamber 21 becomes uniform (and equal to the outside-air pressure), the change valve 34 moves towards the side of the gun-rear end A in response to the valve spring 37. As a result, the change valve 34 closes the blow-back air-supply opening 23 and opens the bullet air-supply opening 22. Furthermore, when the loading pipe 16 passes the opening 4 of the magazine 2 when moving toward the gun-rear end A, the next (i.e., second) bullet W in the magazine 2 is moved upwardly and is positioned in the opening 4.

Furthermore, after the state illustrated in FIGS. 6 and 7 is finished, the slide 10 again moves towards the side of the muzzle B by the force of the slide spring 11 to attain a state similar to that of FIG. 8 and the second bullet W is loaded in the load packing 9. When the trigger is pulled (to discharge the second bullet W), the processes of the FIGS. 6 to 13 are repeated to discharge a bullet W every time the trigger 43 is pulled.

Therefore, it is possible to supply the compressed gas to one of the bullet air-supply opening and the blow-back air-supply opening while closing the other opening, when only the closing portion of the change valve is positioned in the change valve gas chamber, according to the automatic air sport gun of this invention. As a result, it is possible to reduce the resistance of compressed gas flow, when discharging the bullet.

It is also possible to supply the compressed gas smoothly while preventing an unnecessary pressure reduction, in order to discharge the bullet. In addition, the change valve slides without bending and may be used repetitively over a long duration without degradation and/or bending.

Therefore, it is possible to use the gas pressure of the compressed gas to discharge the bullet effectively. It is possible to discharge the bullet without reducing an initial speed of the bullet, i.e., to discharge the bullet efficiently. Furthermore, it is possible to miniaturize the slide of the air gun upper portion and the piston block.

What is claimed is:

1. An automatic air sport gun having a muzzle end and a gun-rear end, the gun comprising:

a compressed gas chamber positioned at a lower position of a barrel for holding a compressed gas, said compressed gas chamber having an exhaust opening for use in exhausting said compressed gas that is positioned at an upper portion of said compressed gas chamber;

a change valve gas chamber having an air-supply opening at a side end of said compressed gas chamber, said air-supply opening being supplied with said compressed gas from said compressed gas chamber, said change valve gas chamber having a bullet air-supply opening at a side end of said barrel, said bullet air-supply opening being for use in supplying said compressed gas for discharging a bullet, said change valve gas chamber having a blow-back air-supply opening adjacent a gun-rear end side of said bullet air-supply opening, said blow-back air-supply being for use in supplying said compressed gas for carrying out a blow-back of a slide;

an open-close valve positioned between said exhaust opening of said compressed gas chamber and said air-supply opening of said change valve gas chamber, said open-close valve constantly biasing said air-supply opening toward a closing state, said open-close valve making said air-supply opening be in an opening state to exhaust the compressed gas in said compressed gas chamber to said change valve gas chamber when said open-close valve is moved against an applied force; and a change valve having a head exposed in said change valve chamber, a part of said head forming a closing portion, said change valve being constantly pushed toward said gun-rear end to close said blow-back air-supply opening with said closing portion, said closing portion opening said blow-back air-supply opening and closing the bullet air-supply opening when said head of said change valve is slid towards a muzzle side against an applied force, wherein said change valve slides when a pressure on a front surface of the head of said change valve is substantially reduced.

2. An automatic air sport gun comprising:

a slide positioned from a muzzle to a side of a gun-rear end on a gun main body, said slide being biased towards a side of said muzzle, said slide being adapted to slide to both directions of said muzzle and said gun-rear end;

a barrel positioned in said slide and along said slide;

a load packing positioned at a side of said gun-rear end for holding loaded bullets;

a magazine positioned at a position lower than that of the load packing in the side of said gun-rear end, said magazine having an upper opening and being adapted to hold the bullets, the bullets being upwardly biased;

a cylinder block positioned at said load packing at a gun-rear end side of the load packing, said cylinder block having a hollow loading pipe mounted at a side of said load packing, said cylinder block having a cylinder portion mounted at a gun-rear end side of the cylinder block, said loading pipe having a bullet discharge ventilating opening having a first end that communicates with a circumferential surface of the cylinder portion and a second end that communicates with the load packing, said cylinder portion having an opening positioned at the gun-rear end side of the cylinder block, said cylinder portion having a blow-back ventilating opening positioned at a loading pipe side of the circumferential surface, said cylinder block being adapted to slide so as to open and close said upper opening of the magazine;

a piston block fixedly positioned in the cylinder portion, the piston block being adapted to be inserted into said cylinder portion to slide in said cylinder portion;

a compressed gas chamber positioned at a lower and rear position of said barrel for holding a compressed gas, said compressed gas chamber having an exhaust opening for use in exhausting said compressed gas that is positioned at an upper portion of said compressed gas chamber;

a change valve gas chamber having an air-supply opening at a side end of said compressed gas chamber, said air-supply opening being supplied with said compressed gas from said compressed gas chamber, said change valve gas chamber having a bullet air-supply opening and a blow-back air-supply opening at a side end of said barrel, said bullet air-supply opening being positioned opposite to the bullet discharge ventilating opening of said loading pipe, said blow-back air-supply opening being adjacent to a gun-rear side of said bullet air-supply opening and being positioned opposite to the blow-back ventilating opening of said cylinder portion, said change valve gas chamber having a stopper projection at an end portion of a partition which separates said bullet air-supply opening from said blow-back sir-supply opening;

an open-close valve positioned between the exhaust opening of said compressed gas chamber and the air-supply opening of said change valve gas chamber to be always pushed so as to make said air-supply opening be in a closing state, said open-close valve making said air-supply opening be in an opening state to able to exhaust the compressed gas in said compressed gas chamber to said change valve gas chamber when said open-close valve is moved against an applied force; and a change valve having a head exposed in said change valve chamber, a part of said head forming a closing portion, said change valve being constantly pushed toward the gun-rear end to close said blow-back air-supply opening by said closing portion, said closing portion being in contact with the stopper projection of said change valve gas chamber to open said blow-back air-supply opening and to close the bullet air-supply opening when said change valve is slid towards a side of a muzzle against an applied force, wherein said change valve being slid when a pressure on a front surface of the head of said change valve is greatly reduced.

3. An automatic air sport gun comprising:

a slide positioned from a muzzle to a side of a gun-rear end on a gun main body, said slide being biased towards a side of said muzzle, said slide being adapted to slide to both directions of said muzzle and said gun-rear end;

a barrel positioned in said slide and along said slide;

a load packing positioned at a side of said gun-rear end for holding bullets;

a magazine positioned at a position lower than that of the load packing in the side of said gun-rear end, said magazine having an upper opening and being adapted to hold the bullets, the bullets being upwardly biased;

a cylinder block positioned at said load packing at a gun-rear end side of the load packing, said cylinder block having a hollow loading pipe mounted at a side of said load packing, said cylinder block having a cylinder portion mounted at a gun-rear end side of the cylinder block, said loading pipe having a bullet discharge ventilating opening having a first end that communicates with a circumferential surface of the cylinder portion and a second end that communicates with the load packing, said cylinder portion having an opening positioned at the gun-rear end side of the cylinder block, said cylinder portion having a blow-back ventilating opening positioned at a loading pipe side of the circumferential surface, said cylinder block being adapted to slide parallel to said slide so as to open and close said upper opening of the magazine;

a piston block fixedly positioned in the cylinder portion, the piston block being adapted to be inserted into said cylinder portion to slide in said cylinder portion as said slide slides;

a hammer attached to a side of said gun-rear end so as to rotate, said hammer being biased so as to rotate towards a direction of a muzzle, said hammer having a blow portion at a muzzle side of said hammer;

a sear portion for engaging with said hammer, the sear portion being adapted to rotate towards said gun-rear end against an applied force, to engage said hammer;

a trigger adapted to be pushed towards the gun-rear side of said gun main body;

a trigger bar having one end connected to said trigger, said trigger bar being synchronized with said trigger when said trigger moves rearward, said trigger bar being adapted to release said hammer from said sear portion to rotate said hammer;

a compressed gas chamber positioned at a lower and rear position of said barrel for holding a compressed gas, said compressed gas chamber having an exhaust opening for use in exhausting said compressed gas that is positioned at an upper portion of said compressed gas chamber;

a change valve gas chamber having an air-supply opening at a side end of said compressed gas chamber, said air-supply opening being supplied with said compressed gas from said compressed gas chamber, said change valve gas chamber having a bullet air-supply opening and a blow-back air-supply opening at a side end of said barrel, said bullet air-supply opening being positioned opposite to the bullet discharge ventilating opening of said loading pipe, said blow-back air-supply opening being positioned opposite to the blow-back ventilating opening of said cylinder portion, said change valve gas chamber having a stopper projection at an end portion of a partition which separates said bullet air-supply opening from said blow-back sir-supply opening;

an open-close valve having a first end that is adapted to open and close the air-supply opening of said change valve gas chamber and a second end that is positioned outside said compressed gas chamber and said change valve gas chamber, said open-close valve being positioned between the exhaust opening of said compressed gas chamber and the air-supply opening of said change valve gas chamber so as to be pushed by the blow portion of said hammer, said open-close valve being constantly pushed so as to make said air-supply opening be in a closing state, said open-close valve making said air-supply opening be in an opening state to exhaust the compressed gas in said compressed gas chamber to said change valve gas chamber when said open-close valve is moved against an applied force;

a change valve having a head exposed in said change valve chamber, a part of said head forming a closing portion, said change valve being constantly pushed toward the gun-rear end to close said blow-back air-supply opening by said closing portion, said closing portion being in contact with the stopper projection of said change valve gas chamber to open said blow-back air-supply opening and to close the bullet air-supply opening when said change valve is slid towards a side of a muzzle against an applied force;

stopper portions being formed on a slide middle portion and on said cylinder block, the stopper portions being adapted to make said cylinder block slide towards said gun-rear end as said slide slides towards said gun-rear end when said stopper portions are engaged with each other;

a loading pipe head of said cylinder block being positioned at a gun-rear end side of the cylinder block and being adjacent the upper opening formed on the magazine when said slide slides as far as possible towards the gun-rear end; and a contact projection being formed at a lower portion of said piston block to be in contact with said hammer when said piston block slides towards the side of said gun-rear end together with said slide, said contact portion pushing said hammer to rotate said hammer against an applied force and to engage said hammer with said sear portion, wherein said change valve slides when a pressure on a front surface of said change valve head is substantially reduced.

* * * * *